US008581523B2

(12) United States Patent
Gall et al.

(10) Patent No.: US 8,581,523 B2
(45) Date of Patent: Nov. 12, 2013

(54) INTERRUPTED PARTICLE SOURCE

(75) Inventors: Kenneth Gall, Harvard, MA (US); Gerrit Townsend Zwart, Durham, NH (US)

(73) Assignee: Mevion Medical Systems, Inc., Littleton, MA (US)

( * ) Notice: Subject to any disclaimer, the term of this patent is extended or adjusted under 35 U.S.C. 154(b) by 1430 days.

(21) Appl. No.: 11/948,662

(22) Filed: Nov. 30, 2007

(65) Prior Publication Data

US 2009/0140672 A1 Jun. 4, 2009

(51) Int. Cl.
*H05H 7/00* (2006.01)

(52) U.S. Cl.
USPC ..... 315/501; 315/505; 315/506; 315/503

(58) Field of Classification Search
USPC ..... 315/501–503, 507; 250/423 R, 424, 250/396 R; 313/62
See application file for complete search history.

(56) References Cited

U.S. PATENT DOCUMENTS

| | | | |
|---|---|---|---|
| 2,280,606 | A | 4/1942 | Van et al. |
| 2,492,324 | A | 12/1949 | Salisbury |
| 2,615,129 | A | 10/1952 | McMillan |
| 2,659,000 | A | 11/1953 | Salisbury |
| 3,175,131 | A | 3/1965 | Burleigh et al. |
| 3,432,721 | A | 3/1969 | Naydan et al. |
| 3,582,650 | A | 6/1971 | Avery |
| 3,679,899 | A | 7/1972 | Dimeff |
| 3,689,847 | A | 9/1972 | Verster |
| 3,757,118 | A | 9/1973 | Hodge et al. |
| 3,868,522 | A | 2/1975 | Bigham et al. |
| 3,886,367 | A | 5/1975 | Castle, Jr. |
| 3,925,676 | A | 12/1975 | Bigham et al. |
| 2,958,327 | A | 5/1976 | Marancik et al. |
| 3,955,089 | A | 5/1976 | McIntyre et al. |
| 3,958,327 | A | 5/1976 | Marancik et al. |
| 3,992,625 | A | 11/1976 | Schmidt et al. |
| 4,038,622 | A | 7/1977 | Purcell |
| 4,047,068 | A | 9/1977 | Ress et al. |
| 4,112,306 | A | 9/1978 | Nunan |
| 4,129,784 | A | 12/1978 | Tschunt et al. |

(Continued)

FOREIGN PATENT DOCUMENTS

| | | |
|---|---|---|
| CA | 2629333 | 5/2007 |
| CN | 1537657 A | 10/2004 |

(Continued)

OTHER PUBLICATIONS

International Search Report and Written Opinion for PCT application No. PCT/US2008/084695 mailed Jan. 26, 2009 (15 pages).

(Continued)

*Primary Examiner* — Douglas W Owens
*Assistant Examiner* — Jianzi Chen
(74) *Attorney, Agent, or Firm* — Fish & Richardson P.C.

(57) ABSTRACT

A synchrocyclotron includes magnetic structures to provide a magnetic field to a cavity, a particle source to provide a plasma column to the cavity, where the particle source has a housing to hold the plasma column, and where the housing is interrupted at an acceleration region to expose the plasma column, and a voltage source to provide a radio frequency (RF) voltage to the cavity to accelerate particles from the plasma column at the acceleration region.

43 Claims, 9 Drawing Sheets

(56) References Cited

U.S. PATENT DOCUMENTS

| | | | |
|---|---|---|---|
| 4,139,777 | A | 2/1979 | Rautenbach |
| 4,197,510 | A | 4/1980 | Szu |
| 4,220,866 | A | 9/1980 | Taumann et al. |
| 4,230,129 | A | 10/1980 | LeVeen |
| 4,256,966 | A | 3/1981 | Heinz |
| 4,293,772 | A | 10/1981 | Stieber |
| 4,336,505 | A | 6/1982 | Meyer |
| 4,342,060 | A | 7/1982 | Gibson |
| 4,345,210 | A | 8/1982 | Tran |
| 4,353,033 | A | 10/1982 | Karasawa |
| 4,425,506 | A | 1/1984 | Brown et al. |
| 4,490,616 | A | 12/1984 | Cipollina et al. |
| 4,507,614 | A | 3/1985 | Prono et al. |
| 4,507,616 | A | 3/1985 | Blosser et al. |
| 4,589,126 | A | 5/1986 | Augustsson et al. |
| 4,598,208 | A | 7/1986 | Brunelli et al. |
| 4,628,523 | A | 12/1986 | Heflin |
| 4,633,125 | A | 12/1986 | Blosser et al. |
| 4,641,057 | A | 2/1987 | Blosser et al. |
| 4,641,104 | A | 2/1987 | Blosser et al. |
| 4,651,007 | A | 3/1987 | Perusek et al. |
| 4,680,565 | A | 7/1987 | Jahnke |
| 4,705,955 | A | 11/1987 | Mileikowsky |
| 4,710,722 | A | 12/1987 | Jahnke |
| 4,726,046 | A | 2/1988 | Nunan |
| 4,734,653 | A | 3/1988 | Jahnke |
| 4,736,173 | A | 4/1988 | Basil et al. |
| 4,737,727 | A | 4/1988 | Yamada et al. |
| 4,739,173 | A | 4/1988 | Blosser et al. |
| 4,745,367 | A | 5/1988 | Dustmann et al. |
| 4,754,147 | A | 6/1988 | Maughan et al. |
| 4,763,483 | A | 8/1988 | Olsen |
| 4,767,930 | A | 8/1988 | Stieber et al. |
| 4,769,623 | A | 9/1988 | Marsing et al. |
| 4,771,208 | A | 9/1988 | Jongen et al. |
| 4,783,634 | A | 11/1988 | Yamamoto et al. |
| 4,808,941 | A | 2/1989 | Marsing |
| 4,812,658 | A | 3/1989 | Koehler |
| 4,843,333 | A | 6/1989 | Marsing et al. |
| 4,845,371 | A | 7/1989 | Stieber |
| 4,865,284 | A | 9/1989 | Gosis et al. |
| 4,868,843 | A | 9/1989 | Nunan |
| 4,868,844 | A | 9/1989 | Nunan |
| 4,870,287 | A | 9/1989 | Cole et al. |
| 4,880,985 | A | 11/1989 | Jones |
| 4,902,993 | A | 2/1990 | Krevet |
| 4,904,949 | A | 2/1990 | Wilson |
| 4,905,267 | A | 2/1990 | Miller et al. |
| 4,917,344 | A | 4/1990 | Prechter et al. |
| 4,943,781 | A | 7/1990 | Wilson et al. |
| 4,945,478 | A | 7/1990 | Merickel et al. |
| 4,968,915 | A | 11/1990 | Wilson et al. |
| 4,987,309 | A | 1/1991 | Klasen et al. |
| 4,996,496 | A | 2/1991 | Kitamura et al. |
| 5,006,759 | A | 4/1991 | Krispel |
| 5,010,562 | A | 4/1991 | Hernandez et al. |
| 5,012,111 | A | 4/1991 | Ueda |
| 5,017,789 | A | 5/1991 | Young et al. |
| 5,017,882 | A | 5/1991 | Finlan |
| 5,036,290 | A | 7/1991 | Sonobe et al. |
| 5,039,057 | A | 8/1991 | Prechter et al. |
| 5,039,867 | A | 8/1991 | Nishihara et al. |
| 5,046,078 | A | 9/1991 | Hernandez et al. |
| 5,072,123 | A | 12/1991 | Johnsen |
| 5,111,173 | A | 5/1992 | Matsuda et al. |
| 5,117,194 | A | 5/1992 | Nakanishi et al. |
| 5,117,212 | A | 5/1992 | Yamamoto et al. |
| 5,117,829 | A | 6/1992 | Miller et al. |
| 5,148,032 | A | 9/1992 | Hernandez |
| 5,166,531 | A | 11/1992 | Huntzinger |
| 5,189,687 | A | 2/1993 | Bova et al. |
| 5,240,218 | A | 8/1993 | Dye |
| 5,260,581 | A | 11/1993 | Lesyna et al. |
| 5,278,533 | A | 1/1994 | Kawaguchi |
| 5,285,166 | A | 2/1994 | Hiramoto et al. |
| 5,317,164 | A | 5/1994 | Kurokawa |
| 5,336,891 | A | 8/1994 | Crewe |
| 5,341,104 | A | 8/1994 | Anton et al. |
| 5,349,198 | A | 9/1994 | Takanaka |
| 5,365,742 | A | 11/1994 | Boffito et al. |
| 5,374,913 | A | 12/1994 | Pissantezky et al. |
| 5,382,914 | A | 1/1995 | Hamm et al. |
| 5,401,973 | A | 3/1995 | McKeown et al. |
| 5,405,235 | A | 4/1995 | Lebre et al. |
| 5,434,420 | A | 7/1995 | McKeown et al. |
| 5,440,133 | A | 8/1995 | Moyers et al. |
| 5,451,794 | A | 9/1995 | McKeown et al. |
| 5,461,773 | A | 10/1995 | Kawaguchi |
| 5,463,291 | A | 10/1995 | Carroll et al. |
| 5,464,411 | A | 11/1995 | Schulte et al. |
| 5,492,922 | A | 2/1996 | Palkowitz |
| 5,511,549 | A | 4/1996 | Legg et al. |
| 5,521,469 | A | 5/1996 | Laisne |
| 5,538,942 | A | 7/1996 | Koyama et al. |
| 5,549,616 | A | 8/1996 | Schulte et al. |
| 5,561,697 | A | 10/1996 | Takafuji et al. |
| 5,585,642 | A | 12/1996 | Britton et al. |
| 5,635,721 | A | 6/1997 | Bardi et al. |
| 5,668,371 | A | 9/1997 | Deasy et al. |
| 5,672,878 | A | 9/1997 | Yao |
| 5,691,679 | A | 11/1997 | Ackermann et al. |
| 5,726,448 | A | 3/1998 | Smith et al. |
| 5,727,554 | A | 3/1998 | Kalend et al. |
| 5,730,745 | A | 3/1998 | Schulte et al. |
| 5,751,781 | A | 5/1998 | Brown et al. |
| 5,778,047 | A | 7/1998 | Mansfield et al. |
| 5,783,914 | A | 7/1998 | Hiramoto et al. |
| 5,784,431 | A | 7/1998 | Kalend et al. |
| 5,797,924 | A | 8/1998 | Schulte et al. |
| 5,811,944 | A | 9/1998 | Sampayan et al. |
| 5,818,058 | A | 10/1998 | Nakanishi et al. |
| 5,821,705 | A | 10/1998 | Caporaso et al. |
| 5,825,845 | A | 10/1998 | Blair et al. |
| 5,841,237 | A | 11/1998 | Alton |
| 5,846,043 | A | 12/1998 | Spath |
| 5,851,182 | A | 12/1998 | Sahadevan |
| 5,866,912 | A | 2/1999 | Slater et al. |
| 5,874,811 | A | 2/1999 | Finlan et al. |
| 5,895,926 | A | 4/1999 | Britton et al. |
| 5,920,601 | A | 7/1999 | Nigg et al. |
| 5,929,458 | A | 7/1999 | Nemezawa et al. |
| 5,963,615 | A | 10/1999 | Egley et al. |
| 5,993,373 | A | 11/1999 | Nonaka et al. |
| 6,008,499 | A | 12/1999 | Hiramoto et al. |
| 6,034,377 | A | 3/2000 | Pu |
| 6,057,655 | A | 5/2000 | Jongen |
| 6,061,426 | A | 5/2000 | Linders et al. |
| 6,066,851 | A | 5/2000 | Madono et al. |
| 6,080,992 | A | 6/2000 | Nonaka et al. |
| 6,087,670 | A | 7/2000 | Hiramoto et al. |
| 6,094,760 | A | 8/2000 | Nonaka et al. |
| 6,118,848 | A | 9/2000 | Reiffel |
| 6,144,875 | A | 11/2000 | Schweikard et al. |
| 6,158,708 | A | 12/2000 | Egley et al. |
| 6,207,952 | B1 | 3/2001 | Kan et al. |
| 6,219,403 | B1 | 4/2001 | Nishihara |
| 6,222,905 | B1 | 4/2001 | Yoda et al. |
| 6,241,671 | B1 | 6/2001 | Ritter et al. |
| 6,246,066 | B1 | 6/2001 | Yuehu |
| 6,256,591 | B1 | 7/2001 | Yoda et al. |
| 6,265,837 | B1 | 7/2001 | Akiyama et al. |
| 6,268,610 | B1 | 7/2001 | Pu |
| 6,278,239 | B1 | 8/2001 | Caporaso et al. |
| 6,279,579 | B1 | 8/2001 | Riaziat et al. |
| 6,307,914 | B1 | 10/2001 | Kunieda et al. |
| 6,316,776 | B1 | 11/2001 | Hiramoto et al. |
| 6,366,021 | B1 | 4/2002 | Meddaugh et al. |
| 6,369,585 | B2 | 4/2002 | Yao |
| 6,407,505 | B1 | 6/2002 | Bertsche |
| 6,417,634 | B1 | 7/2002 | Bergstrom |
| 6,433,336 | B1 | 8/2002 | Jongen et al. |
| 6,433,349 | B2 | 8/2002 | Akiyama et al. |
| 6,433,494 | B1 | 8/2002 | Kulish et al. |
| 6,441,569 | B1 | 8/2002 | Janzow |

(56) References Cited

U.S. PATENT DOCUMENTS 6,443,349 B1 9/2002 Van Der Burg
6,465,957 B1 10/2002 Whitham et al.
6,472,834 B2 10/2002 Hiramoto et al.
6,476,403 B1 11/2002 Dolinskii et al.
6,492,922 B1 12/2002 New
6,493,424 B2 12/2002 Whitham
6,498,444 B1 12/2002 Hanna et al.
6,501,981 B1 12/2002 Schweikard et al.
6,519,316 B1 2/2003 Collins
6,593,696 B2 7/2003 Ding et al.
6,594,336 B2 7/2003 Nishizawa et al.
6,600,164 B1 7/2003 Badura et al.
6,617,598 B1 9/2003 Matsuda
6,621,889 B1 9/2003 Mostafavi
6,639,234 B1 10/2003 Badura et al.
6,646,383 B2 11/2003 Bertsche et al.
6,670,618 B1 12/2003 Hartmann et al.
6,683,318 B1 1/2004 Haberer et al.
6,683,426 B1 1/2004 Kleeven
6,693,283 B2 2/2004 Eickhoff et al.
6,710,362 B2 3/2004 Kraft et al.
6,713,976 B1 3/2004 Zumoto et al.
6,717,162 B1 4/2004 Jongen
6,736,831 B1 5/2004 Hartmann et al.
6,745,072 B1 6/2004 Badura et al.
6,769,806 B2 8/2004 Moyers
6,774,383 B2 8/2004 Norimine et al.
6,777,689 B2 8/2004 Nelson
6,777,700 B2 8/2004 Yanagisawa et al.
6,780,149 B1 8/2004 Schulte
6,799,068 B1 9/2004 Hartmann et al.
6,800,866 B2 10/2004 Amemiya et al.
6,803,591 B2 10/2004 Muramatsu et al.
6,814,694 B1 11/2004 Pedroni
6,822,244 B2 11/2004 Beloussov et al.
6,853,142 B2 2/2005 Chistyakov
6,853,703 B2 2/2005 Svatos et al.
6,864,770 B2 3/2005 Nemoto et al.
6,865,254 B2 3/2005 Nafstadius
6,873,123 B2 3/2005 Marchand et al.
6,891,177 B1 5/2005 Kraft et al.
6,891,924 B1 5/2005 Yoda et al.
6,894,300 B2 5/2005 Reimoser et al.
6,897,451 B2 5/2005 Kaercher et al.
6,914,396 B1 7/2005 Symons et al.
6,936,832 B2 8/2005 Norimine et al.
6,953,943 B2 10/2005 Yanagisawa et al.
6,969,194 B1 11/2005 Nafstadius
6,979,832 B2 12/2005 Yanagisawa et al.
6,984,835 B2 1/2006 Harada
6,992,312 B2 1/2006 Yanagisawa et al.
6,993,112 B2 1/2006 Hesse
7,008,105 B2 3/2006 Amann et al.
7,011,447 B2 3/2006 Moyers
7,012,267 B2 3/2006 Moriyama et al.
7,014,361 B1 3/2006 Ein-Gal
7,026,636 B2 4/2006 Yanagisawa et al.
7,049,613 B2 5/2006 Yanagisawa et al.
7,053,389 B2 5/2006 Yanagisawa et al.
7,054,801 B2 5/2006 Sakamoto et al.
7,060,997 B2 6/2006 Norimine et al.
7,071,479 B2 7/2006 Yanagisawa et al.
7,073,508 B2 7/2006 Moyers
7,081,619 B2 7/2006 Bashkirov et al.
7,084,410 B2 8/2006 Beloussov et al.
7,091,478 B2 8/2006 Haberer
7,102,144 B2 9/2006 Matsuda et al.
7,122,811 B2 10/2006 Matsuda et al.
7,122,966 B2 * 10/2006 Norling et al. ..... 315/111.81
7,122,978 B2 10/2006 Nakanishi et al.
7,138,771 B2 11/2006 Bechthold et al.
7,154,107 B2 12/2006 Yanagisawa et al.
7,154,108 B2 12/2006 Tadokoro et al.
7,154,991 B2 12/2006 Earnst et al.
7,173,264 B2 2/2007 Moriyama et al.
7,173,265 B2 2/2007 Miller et al.
7,173,385 B2 2/2007 Caporaso et al.
7,186,991 B2 3/2007 Kato et al.
7,193,227 B2 3/2007 Hiramoto et al.
7,199,382 B2 4/2007 Rigney et al.
7,208,748 B2 4/2007 Sliski et al.
7,212,608 B2 5/2007 Nagamine et al.
7,212,609 B2 5/2007 Nagamine et al.
7,221,733 B1 5/2007 Takai et al.
7,227,161 B2 6/2007 Matsuda et al.
7,247,869 B2 7/2007 Tadokoro et al.
7,257,191 B2 8/2007 Sommer
7,259,529 B2 8/2007 Tanaka
7,262,424 B2 8/2007 Moriyama et al.
7,280,633 B2 10/2007 Cheng et al.
7,297,967 B2 11/2007 Yanagisawa et al.
7,301,162 B2 11/2007 Matsuda et al.
7,307,264 B2 12/2007 Brusasco et al.
7,318,805 B2 1/2008 Schweikard et al.
7,319,231 B2 1/2008 Moriyama et al.
7,331,713 B2 2/2008 Moyers
7,332,880 B2 2/2008 Ina et al.
7,345,291 B2 3/2008 Kats
7,345,292 B2 3/2008 Moriyama et al.
7,348,579 B2 3/2008 Pedroni
7,351,988 B2 4/2008 Naumann et al.
7,355,189 B2 4/2008 Yanagisawa et al.
7,368,740 B2 5/2008 Beloussov et al.
7,372,053 B2 5/2008 Yamashita et al.
7,378,672 B2 5/2008 Harada
7,381,979 B2 6/2008 Yamashita et al.
7,397,054 B2 7/2008 Natori et al.
7,397,901 B1 7/2008 Johnsen
7,398,309 B2 7/2008 Baumann et al.
7,402,822 B2 7/2008 Guertin et al.
7,402,823 B2 7/2008 Guertin et al.
7,402,824 B2 7/2008 Guertin et al.
7,402,963 B2 7/2008 Sliski
7,405,407 B2 7/2008 Hiramoto et al.
7,425,717 B2 9/2008 Matsuda et al.
7,432,516 B2 10/2008 Peggs et al.
7,439,528 B2 10/2008 Nishiuchi et al.
7,446,328 B2 11/2008 Rigney et al.
7,446,490 B2 11/2008 Jongen et al.
7,449,701 B2 11/2008 Fujimaki et al.
7,465,944 B2 12/2008 Ueno et al.
7,466,085 B2 12/2008 Nutt
7,473,913 B2 1/2009 Hermann et al.
7,476,867 B2 1/2009 Fritsch et al.
7,476,883 B2 1/2009 Nutt
7,482,606 B2 1/2009 Groezinger et al.
7,492,556 B2 2/2009 Atkins et al.
7,507,975 B2 3/2009 Mohr
7,525,104 B2 4/2009 Harada
7,541,905 B2 6/2009 Antaya
7,547,901 B2 6/2009 Guertin et al.
7,555,103 B2 6/2009 Johnsen
7,560,715 B2 7/2009 Pedroni
7,560,717 B2 7/2009 Matsuda et al.
7,567,694 B2 7/2009 Lu et al.
7,574,251 B2 8/2009 Lu et al.
7,576,499 B2 8/2009 Caporaso et al.
7,579,603 B2 8/2009 Birgy et al.
7,579,610 B2 8/2009 Grozinger et al.
7,582,886 B2 9/2009 Trbojevic
7,586,112 B2 9/2009 Chiba et al.
7,609,009 B2 10/2009 Tanaka et al.
7,609,809 B2 10/2009 Kapatoes et al.
7,609,811 B1 10/2009 Siljamaki et al.
7,615,942 B2 11/2009 Sanders et al.
7,626,347 B2 12/2009 Sliski
7,629,598 B2 12/2009 Harada
7,639,853 B2 12/2009 Olivera et al.
7,639,854 B2 12/2009 Schnarr et al.
7,643,661 B2 1/2010 Ruchala et al.
7,656,258 B1 2/2010 Antaya et al.
7,659,521 B2 2/2010 Pedroni
7,668,291 B2 2/2010 Nord et al.
7,672,429 B2 3/2010 Urano et al.

(56) References Cited

U.S. PATENT DOCUMENTS

| | | | |
|---|---|---|---|
| 7,679,073 | B2 | 3/2010 | Urano et al. |
| 7,682,078 | B2 | 3/2010 | Rietzel |
| 7,692,168 | B2 | 4/2010 | Moriyama et al. |
| 7,696,499 | B2 | 4/2010 | Miller et al. |
| 7,696,847 | B2 | 4/2010 | Antaya |
| 7,701,677 | B2 | 4/2010 | Schultz et al. |
| 7,709,818 | B2 | 5/2010 | Matsuda et al. |
| 7,710,051 | B2 | 5/2010 | Caporaso et al. |
| 7,718,982 | B2 | 5/2010 | Sliski |
| 7,728,311 | B2 | 6/2010 | Gall |
| 7,746,978 | B2 | 6/2010 | Cheng et al. |
| 7,755,305 | B2 | 7/2010 | Umezawa et al. |
| 7,763,867 | B2 | 7/2010 | Birgy et al. |
| 7,767,988 | B2 | 8/2010 | Kaiser et al. |
| 7,772,577 | B2 | 8/2010 | Saito et al. |
| 7,773,723 | B2 | 8/2010 | Nord et al. |
| 7,773,788 | B2 | 8/2010 | Lu et al. |
| 7,778,488 | B2 | 8/2010 | Nord et al. |
| 7,783,010 | B2 | 8/2010 | Clayton |
| 7,784,127 | B2 | 8/2010 | Kuro et al. |
| 7,789,560 | B2 | 9/2010 | Moyers |
| 7,791,051 | B2 | 9/2010 | Beloussov et al. |
| 7,796,731 | B2 | 9/2010 | Nord et al. |
| 7,801,269 | B2 | 9/2010 | Cravens et al. |
| 7,801,270 | B2 | 9/2010 | Nord et al. |
| 7,801,988 | B2 | 9/2010 | Baumann et al. |
| 7,809,107 | B2 | 10/2010 | Nord et al. |
| 7,812,319 | B2 | 10/2010 | Diehl et al. |
| 7,812,326 | B2 | 10/2010 | Grozinger et al. |
| 7,816,657 | B2 | 10/2010 | Hansmann et al. |
| 7,817,778 | B2 | 10/2010 | Nord et al. |
| 7,817,836 | B2 | 10/2010 | Chao et al. |
| 7,834,334 | B2 | 11/2010 | Grozinger et al. |
| 7,834,336 | B2 | 11/2010 | Boeh et al. |
| 7,835,494 | B2 | 11/2010 | Nord et al. |
| 7,835,502 | B2 | 11/2010 | Spence et al. |
| 7,839,972 | B2 | 11/2010 | Ruchala et al. |
| 7,839,973 | B2 | 11/2010 | Nord et al. |
| 7,860,216 | B2 | 12/2010 | Jongen et al. |
| 7,860,550 | B2 | 12/2010 | Saracen et al. |
| 7,868,301 | B2 | 1/2011 | Diehl |
| 7,875,861 | B2 | 1/2011 | Huttenberger et al. |
| 7,875,868 | B2 | 1/2011 | Moriyama et al. |
| 7,881,431 | B2 | 2/2011 | Aoi et al. |
| 7,906,769 | B2 | 3/2011 | Blasche et al. |
| 7,919,765 | B2 | 4/2011 | Timmer |
| 7,920,040 | B2 | 4/2011 | Antaya et al. |
| 7,920,675 | B2 | 4/2011 | Lomax et al. |
| 7,928,415 | B2 | 4/2011 | Bert et al. |
| 7,934,869 | B2 | 5/2011 | Ivanov et al. |
| 7,940,881 | B2 | 5/2011 | Jongen et al. |
| 7,947,969 | B2 | 5/2011 | Pu |
| 7,949,096 | B2 | 5/2011 | Cheng et al. |
| 7,960,710 | B2 | 6/2011 | Kruip et al. |
| 7,961,844 | B2 | 6/2011 | Takeda et al. |
| 7,977,656 | B2 | 7/2011 | Fujimaki et al. |
| 7,982,416 | B2 | 7/2011 | Tanaka et al. |
| 7,984,715 | B2 | 7/2011 | Moyers |
| 7,987,053 | B2 | 7/2011 | Schaffner |
| 7,989,785 | B2 | 8/2011 | Emhofer et al. |
| 7,997,553 | B2 | 8/2011 | Sloan et al. |
| 8,002,466 | B2 | 8/2011 | Von Neubeck et al. |
| 8,003,964 | B2 | 8/2011 | Stark et al. |
| 8,009,803 | B2 | 8/2011 | Nord et al. |
| 8,009,804 | B2 | 8/2011 | Siljamaki et al. |
| 8,039,822 | B2 | 10/2011 | Rietzel |
| 8,044,364 | B2 | 10/2011 | Yamamoto |
| 8,049,187 | B2 | 11/2011 | Tachikawa |
| 8,053,739 | B2 | 11/2011 | Rietzel |
| 8,053,746 | B2 | 11/2011 | Timmer et al. |
| 8,069,675 | B2 | 12/2011 | Radovinsky et al. |
| 8,071,966 | B2 | 12/2011 | Kaiser et al. |
| 8,080,801 | B2 | 12/2011 | Safai |
| 8,111,125 | B2 | 2/2012 | Antaya et al. |
| 8,173,981 | B2 | 5/2012 | Trbojevic |
| 8,222,613 | B2 | 7/2012 | Tajiri et al. |
| 8,291,717 | B2 | 10/2012 | Radovinsky et al. |
| 8,344,340 | B2 | 1/2013 | Gall |
| 8,368,043 | B2 | 2/2013 | Havelange et al. |
| 8,389,949 | B2 | 3/2013 | Harada et al. |
| 8,426,833 | B2 | 4/2013 | Trbojevic |
| 2002/0172317 | A1 | 11/2002 | Maksimchuk et al. |
| 2003/0048080 | A1 | 3/2003 | Amemiya et al. |
| 2003/0125622 | A1 | 7/2003 | Schweikard et al. |
| 2003/0136924 | A1 | 7/2003 | Kraft et al. |
| 2003/0152197 | A1 | 8/2003 | Moyers |
| 2003/0163015 | A1 | 8/2003 | Yanagisawa et al. |
| 2003/0183779 | A1 | 10/2003 | Norimine et al. |
| 2003/0234369 | A1 | 12/2003 | Glukhoy |
| 2004/0000650 | A1 | 1/2004 | Yanagisawa et al. |
| 2004/0017888 | A1 | 1/2004 | Seppi et al. |
| 2004/0056212 | A1 | 3/2004 | Yanagisawa et al. |
| 2004/0061077 | A1 | 4/2004 | Muramatsu et al. |
| 2004/0061078 | A1 | 4/2004 | Muramatsu et al. |
| 2004/0085023 | A1 | 5/2004 | Chistakov |
| 2004/0098445 | A1 | 5/2004 | Baumann et al. |
| 2004/0111134 | A1 | 6/2004 | Muramatsu et al. |
| 2004/0118081 | A1 | 6/2004 | Reimoser et al. |
| 2004/0149934 | A1 | 8/2004 | Yanagisawa et al. |
| 2004/0159795 | A1 | 8/2004 | Kaercher et al. |
| 2004/0173763 | A1 | 9/2004 | Moriyama et al. |
| 2004/0174958 | A1 | 9/2004 | Moriyama et al. |
| 2004/0183033 | A1 | 9/2004 | Moriyama et al. |
| 2004/0183035 | A1 | 9/2004 | Yanagisawa et al. |
| 2004/0200982 | A1 | 10/2004 | Moriyama et al. |
| 2004/0200983 | A1 | 10/2004 | Fujimaki et al. |
| 2004/0213381 | A1 | 10/2004 | Harada |
| 2004/0227104 | A1 | 11/2004 | Matsuda et al. |
| 2004/0232356 | A1 | 11/2004 | Norimine et al. |
| 2004/0240626 | A1 | 12/2004 | Moyers |
| 2005/0058245 | A1 | 3/2005 | Ein-Gal |
| 2005/0089141 | A1 | 4/2005 | Brown |
| 2005/0161618 | A1 | 7/2005 | Pedroni |
| 2005/0184686 | A1 | 8/2005 | Caporaso et al. |
| 2005/0228255 | A1 | 10/2005 | Saracen et al. |
| 2005/0234327 | A1 | 10/2005 | Saracen et al. |
| 2005/0247890 | A1 | 11/2005 | Norimine et al. |
| 2006/0017015 | A1 | 1/2006 | Sliski et al. |
| 2006/0067468 | A1 | 3/2006 | Rietzel |
| 2006/0126792 | A1 | 6/2006 | Li |
| 2006/0145088 | A1 | 7/2006 | Ma |
| 2006/0175991 | A1 | 8/2006 | Fujisawa |
| 2006/0284562 | A1 | 12/2006 | Hruby et al. |
| 2007/0001128 | A1 | 1/2007 | Sliski et al. |
| 2007/0013273 | A1 | 1/2007 | Albert et al. |
| 2007/0014654 | A1 | 1/2007 | Haverfield et al. |
| 2007/0023699 | A1 | 2/2007 | Yamashita et al. |
| 2007/0029510 | A1 | 2/2007 | Hermann et al. |
| 2007/0051904 | A1 | 3/2007 | Kaiser et al. |
| 2007/0092812 | A1 | 4/2007 | Caporaso et al. |
| 2007/0145916 | A1 | 6/2007 | Caporaso et al. |
| 2007/0171015 | A1 | 7/2007 | Antaya |
| 2007/0181519 | A1 | 8/2007 | Khoshnevis |
| 2007/0284548 | A1 | 12/2007 | Kaiser et al. |
| 2008/0093567 | A1 | 4/2008 | Gall |
| 2008/0218102 | A1 | 9/2008 | Sliski |
| 2009/0096179 | A1 | 4/2009 | Stark et al. |
| 2009/0140671 | A1 | 6/2009 | O'Neal, III et al. |
| 2009/0140672 | A1 | 6/2009 | Gall et al. |
| 2009/0200483 | A1 | 8/2009 | Gall et al. |
| 2010/0045213 | A1 | 2/2010 | Sliski |
| 2010/0230617 | A1 | 9/2010 | Gall |
| 2010/0308235 | A1 | 12/2010 | Sliski |
| 2011/0299919 | A1 | 12/2011 | Stark |
| 2013/0053616 | A1 | 2/2013 | Gall |
| 2013/0127375 | A1 | 5/2013 | Sliski |
| 2013/0131424 | A1 | 5/2013 | Sliski |

FOREIGN PATENT DOCUMENTS

| | | | |
|---|---|---|---|
| CN | 1816243 | A | 8/2006 |
| CN | 101932361 | | 12/2010 |
| CN | 101933405 | | 12/2010 |
| CN | 101933405 | A | 12/2010 |

(56) References Cited

FOREIGN PATENT DOCUMENTS

| | | | |
|---|---|---|---|
| CN | 101933406 | | 12/2010 |
| CN | 101061759 | | 5/2011 |
| DE | 27 53 397 | | 6/1978 |
| DE | 31 48 100 | | 6/1983 |
| DE | 35 30 446 | | 8/1984 |
| DE | 41 01 094 | C1 | 5/1992 |
| DE | 4411171 | | 10/1995 |
| EP | 0194728 | | 9/1986 |
| EP | 0 277 521 | | 8/1988 |
| EP | 0 208 163 | B1 | 1/1989 |
| EP | 0 222 786 | | 7/1990 |
| EP | 0 221 987 | | 1/1991 |
| EP | 0499253 | | 8/1992 |
| EP | 0 306 966 | | 4/1995 |
| EP | 0 388 123 | | 5/1995 |
| EP | 0 465 597 | | 5/1997 |
| EP | 0 864 337 | | 9/1998 |
| EP | 0 776 595 | | 12/1998 |
| EP | 1 069 809 | | 1/2001 |
| EP | 1 153 398 | A1 | 4/2001 |
| EP | 1 294 445 | | 3/2003 |
| EP | 1 348 465 | | 10/2003 |
| EP | 1 358 908 | | 11/2003 |
| EP | 1 371 390 | | 12/2003 |
| EP | 1 402 923 | | 3/2004 |
| EP | 0 911 064 | | 6/2004 |
| EP | 1 430 932 | | 6/2004 |
| EP | 1430932 | | 6/2004 |
| EP | 1 454 653 | | 9/2004 |
| EP | 1 454 654 | | 9/2004 |
| EP | 1 454 655 | A2 | 9/2004 |
| EP | 1 454 656 | | 9/2004 |
| EP | 1 454 657 | | 9/2004 |
| EP | 1 477 206 | | 11/2004 |
| EP | 1 605 742 | A1 | 12/2005 |
| EP | 1 738 798 | | 1/2007 |
| EP | 1826778 | | 8/2007 |
| EP | 1949404 | | 7/2008 |
| EP | 2227295 | | 9/2010 |
| EP | 2232961 | | 9/2010 |
| EP | 2232962 | | 9/2010 |
| EP | 2227295 | | 5/2011 |
| EP | 2363170 | | 9/2011 |
| EP | 2363171 | | 9/2011 |
| FR | 2 560 421 | | 8/1985 |
| FR | 2911843 | | 8/2008 |
| GB | 957342 | | 5/1964 |
| GB | 2015821 | A | 9/1979 |
| GB | 2 361 523 | | 10/2001 |
| JP | 43-23267 | | 10/1968 |
| JP | S47-028762 | | 3/1972 |
| JP | U48-108098 | | 9/1973 |
| JP | 61-80800 | | 4/1986 |
| JP | 61-225798 | | 10/1986 |
| JP | A 61-225798 | | 10/1986 |
| JP | 62-150804 | | 7/1987 |
| JP | 62-186500 | | 8/1987 |
| JP | 63-149344 | | 6/1988 |
| JP | 63-218200 | | 9/1988 |
| JP | 63-226899 | | 9/1988 |
| JP | 1-276797 | | 11/1989 |
| JP | 4-94198 | | 3/1992 |
| JP | 04-128717 | | 4/1992 |
| JP | 04-129768 | | 4/1992 |
| JP | 04-273409 | | 9/1992 |
| JP | 04-337300 | | 11/1992 |
| JP | 05-341352 | | 12/1993 |
| JP | 06233831 | | 8/1994 |
| JP | 06233831 | A | 8/1994 |
| JP | 06-036893 | | 10/1994 |
| JP | 2007-260939 | A | 10/1995 |
| JP | 07260939 | | 10/1995 |
| JP | 08-173890 | | 7/1996 |
| JP | 08-264298 | | 10/1996 |
| JP | 09-162585 | | 6/1997 |
| JP | 10-071213 | | 3/1998 |
| JP | 11-47287 | | 2/1999 |
| JP | 11-102800 | | 4/1999 |
| JP | 11-243295 | | 9/1999 |
| JP | 2000-243309 | | 9/2000 |
| JP | 2000-294399 | | 10/2000 |
| JP | 2001-6900 | | 1/2001 |
| JP | 2001-129103 | | 5/2001 |
| JP | 2002-164686 | | 6/2002 |
| JP | 2003-504628 | | 2/2003 |
| JP | A2003-504628 | | 2/2003 |
| JP | 2004-031115 | | 1/2004 |
| JP | 2004-031115 | A | 1/2004 |
| JP | 2006-32282 | | 2/2006 |
| JP | 2006-032282 | | 2/2006 |
| JP | 2009-515671 | | 4/2009 |
| JP | S48-108098 | | 3/2010 |
| JP | 2010-536130 | | 11/2010 |
| JP | 2011-505191 | | 2/2011 |
| JP | 2011-505670 | | 2/2011 |
| JP | 2011-507151 | | 3/2011 |
| JP | 5046928 | | 7/2012 |
| SU | 300137 | | 11/1969 |
| SU | 569 635 | | 8/1977 |
| TW | 200930160 | | 7/2009 |
| TW | 200934682 | | 8/2009 |
| TW | 200939908 | | 9/2009 |
| TW | 200940120 | | 10/2009 |
| WO | WO 86/07229 | | 12/1986 |
| WO | WO90/12413 | | 10/1990 |
| WO | WO 92/03028 | | 2/1992 |
| WO | WO 93/02536 | | 2/1993 |
| WO | WO 98/17342 | | 4/1998 |
| WO | WO99/39385 | | 8/1999 |
| WO | WO 00/40064 | | 7/2000 |
| WO | WO 00/49624 | | 8/2000 |
| WO | 01/05199 | | 1/2001 |
| WO | WO 01/26569 | | 4/2001 |
| WO | WO 02/07817 | | 1/2002 |
| WO | WO 03/039212 | | 5/2003 |
| WO | WO 03/092812 | | 11/2003 |
| WO | WO 2004/026401 | | 4/2004 |
| WO | WO 2004/101070 | | 11/2004 |
| WO | WO 2006/012467 | | 2/2006 |
| WO | 2007/061937 | | 5/2007 |
| WO | WO2007/061937 | | 5/2007 |
| WO | WO2007/084701 | | 7/2007 |
| WO | WO2007/130164 | | 11/2007 |
| WO | WO2007/145906 | | 12/2007 |
| WO | WO2008/030911 | | 3/2008 |
| WO | WO 2008/081480 | | 10/2008 |
| WO | WO 2009/048745 | | 4/2009 |
| WO | WO2009-070173 | | 6/2009 |
| WO | WO2009-070588 | | 6/2009 |
| WO | WO2009-073480 | | 6/2009 |
| WO | WO 2009/048745 | | 11/2009 |

OTHER PUBLICATIONS

International Search Report and Written Opinion mailed Oct. 1, 2009 in PCT application No. PCT/US2008/077513 (73 pages).

European Patent Office communication for application No. 06838033.6, patent No. 1949404, mailed Aug. 5, 2009 (1 page).

Invitation to Pay Additional Fees and, where applicable, Protest Fees with partial search report for application No. PCT/US2008/077513 mailed Jul. 3, 2009 (62 pages).

Office action and response history of U.S. Appl. No. 11/601,056 to Aug. 24, 2009.

U.S. Appl. No. 11/601,056, filed Nov. 17, 2006.

Flanz, et al., "Operation of a Cyclotron Based Proton Therapy Facility", Massachusetts General Hospital, Boston, MA 02114, pp. 1-4.

Resmini, F., "Design Characteristics of the K=800 Superconducting Cyclotron at M.S.U.", Cyclotron Laboratory, Michigan State University, East Lansing, Michigan 48824, IEEE Transaction on Nuclear Science, vol. NS-26, No. 2, Apr. 1979 (8 pages).

European Search Report from application No. EP 06838033.6 (PCT/US2006/044853) mailed May 11, 2009 (69 pages).

(56) References Cited

OTHER PUBLICATIONS

Office action and response history of U.S. Appl. No. 11/601,056 to Mar. 24, 2009.
U.S. Appl. No. 60/738,404, filed Nov. 18, 2005.
U.S. Appl. No. 11/948,359, filed Nov. 30, 2007.
PCT application No. PCT/US2006/44853, filed on Nov. 17, 2006, with Publication No. WO/2007/061937.
U.S. Appl. No. 10/949,734, filed Sep. 24, 2004, Patent No. 7,208,748, issued on Apr. 24, 2007.
U.S. Appl. No. 11/724,055, filed Mar. 14, 2007.
U.S. Appl. No. 11/371,622, filed Mar. 9, 2006.
U.S. Appl. No. 60/590,088, filed Jul. 21, 2004.
U.S. Appl. No. 11/187,633, filed Jul. 21, 2005.
PCT application No. PCT/US2005/25942 filed on Jul. 21, 2005, with Publication No. WO/2006/012452.
U.S. Appl. No. 11/463,403, filed Aug. 9, 2006.
U.S. Appl. No. 11/517,490, filed Sep. 7, 2006.
U.S. Appl. No. 11/624,769, filed Jan. 19, 2007.
PCT application No. PCT/US2007/01506 filed on Jan. 19, 2007, with Publication No. WO/2007/084701.
PCT application No. PCT/US2007/01628 filed on Jan. 19, 2007, with Publication No. WO/2007/130164.
PCT application No. PCT/US2007/77693 filed on Sep. 6, 2007with Publication No. WO/2007/77693.
U.S. Appl. No. 11/870,961, filed Oct. 11, 2007.
PCT application No. PCT/US2008/077513, filed on Sep. 24, 2008.
PCT application No. PCT/US2008/084695 filed on Nov. 25, 2008.
PCT application No. PCT/US2008/084699 filed on Nov. 25, 2008.
U.S. Appl. No. 60/991,454, filed Nov. 30, 2007.
U.S. Appl. No. 12/275,103, filed Nov. 20, 2008.
PCT application No. PCT/US2007/086109 filed on Nov. 30, 2007.
U.S. Appl. No. 60/850,565, filed Oct. 10, 2006.
PCT International Search report and Written Opinion of PCT application No. PCT/US2006/044853, mailed Oct. 5, 2007 (12 pages).
PCT International Preliminary Report on Patentability of corresponding PCT application No. PCT/US2006/044853, mailed May 29, 2008 (8 pages).
International Search Report dated Aug. 26, 2008 in PCT application No. PCT/US2007/086109 (6 pages).
Written Opinion dated Aug. 26, 2008 in PCT application No. PCT/US2007/086109 (6 pages).
International Search Report and Written Opinion for PCT application No. PCT/US2008/084699 mailed Feb. 4, 2009 (11 pages).
International Search Report and Written Opinion for PCT application No. PCT/US2007/001506 mailed Jul. 5, 2007, Publication No. WO2007/084701, Published Jul. 26, 2007 (14 pages).
International Preliminary Report on Patentability for PCT application No. PCT/US2007/001506 mailed Jul. 5, 2007 (15 pages).
International Search Report for PCT/US2007/001628 mailed Feb. 18, 2008 (4 pages).
Written Opinion for PCT/US2007/001628, mailed Feb. 18, 2008 (11 pages).
International Preliminary Report on Patentability for PCT/US2007/001628, mailed Apr. 22, 2008 (15 pages).
Abrosimov, N.K., et al. Proc. Academy Science, USSR 5, 84 (1985).
Abrosimov, N.K., et al, "1000MeV Proton Beam Therapy facility at Petersburg Nuclear Physics Institute Synchrocyclotron", Medical Radiology (Moscow) 32, 10 (1987) revised in Journal of Physics, Conference Series 41, pp. 424-432, Institute of Physics Publishing Limited, 2006.
Adachi, T., et. al. "A 150MeV FFAG Synchrotron with "Return-Yoke Free" Magent" *Proceedings of the 2001 Particle Accelerator Conference*, Chicago (2001).
Ageyev, A. I., et. al. "The IHEP Accelerating and Storage Complex (UNK) Status Report" *11th International Conference on High-Energy Accelerators*, pp. 60-70 (Jul. 7-11, 1980).
Agosteo, S., et. al. "Maze Design of a gantry room for proton therapy" *Nuclear Instruments & Methods in Physics Research*, Section A, 382, pp. 573-582 (1996).
Allardyce, B. W., et al., "Performance and Prospects of the Reconstructed CERN 600 MeV Synchrocyclotron" IEEE Transactions on Nuclear Science USA ns-24:(3), pp. 1631-1633 (Jun. 1977).
Alexeev, V. P., et. al. "R4 Design of Superconducting Magents for Proton Synchrotrons" *Proceedings of the Fifth International Cryogenic Engineering Conference*, pp. 531-533 (1974).
Amaldi, U. "Overview of the world landscape of Hadrontherapy and the projects of the TERA foundation" *Physica Medica, An International journal Devoted to the Applications of Physics to Medicine and Biology*, vol. XIV, Supplement 1 (Jul. 1998), *6th Workshop on Heavy Charged Particles in Biology and Medicine*, Instituto Scientific Europeo (ISE), Baveno, pp. 76-85 (Sep. 29-Oct. 1, 1997).
Amaldi, U., et. al. "The Italian project for a hadrontherapy centre" *Nuclear Instruments and Methods in Physics Research A*, 360, pp. 297-301 (1995).
"An Accelerated Collaboration Meets with Beaming Success", Lawrence Livermore National Laboratory, Apr. 12, 2006, S&TR,,Livermore, California, pp. 1-3. http://www.llnl.gov/str/April06/Caporaso.html.
Anferov, V., et. al. "The Indiana University Midwest Proton Radiation Institute" *Proceedings of the 2001 Particle Accelerator Conference*, Chicago, pp. 645-647 (2001).
Anferov, V., et. al. "Status of the Midwest Proton Radiotherapy Institute", *Proceedings of the 2003 Particle Accelerator Conference*, pp. 699-701 (2003).
Appun, J. "Various problems of magnet fabrication for high-energy accelerators" *Journal for All Engineers Interested in the Nuclear Field*, pp. 10-16 (1967) [Lang.: German], English bibliographic information (http://www.osti.gov/energycitations/product.biblio.jsp?osti_id=4442292).
Arduini, G., et. al. "Physical specifications of clinical proton beams from a synchrotron" *Med. Phys*. 23 (6), pp. 939-951 (Jun. 1996).
Beeckman, W., et. al. "Preliminary design of a reduced cost proton therapy facility using a compact, high field isochronous cyclotron" *Nuclear Instruments and Methods in Physics Reasearch B*56/57, pp. 1201-1204 (1991).
Bellomo, G., et al., "The Superconducting Cyclotron Program at Michigan State University" *Bulletin of the American Physical Society*, vol. 25, No. 7, pp. 767 (Sep. 1980).
Benedikt, M. and Carli, C. "Matching to Gantries for Medical Synchrotrons" *IEEE Proceedings of the 1997 Particle Accelerator Conference*, pp. 1379-1381 (1997).
Bieth, C., et. al. "A Very Compact Protontherapy Facility Based on an Extensive Use of High Temperature Superconductors (HTS)" *Cyclotrons and their Applications* 1998, Proceedings of the Fifteenth International Conference on Cyclotrons and their Applications, Caen, pp. 669-672 (Jun. 14-19, 1998).
Bigham, C.B. "Magnetic Trim Rods for Superconducting Cyclotrons," Nuclear Instruments and Methods (North-Holland Publishing Co.) 141 (1975), pp. 223-228.
Blackmore, E. W., et. al. "Operation of the Triumf Proton Therapy Facility" *IEEE Proceedings of the 1997 Particle Accelerator Conferenc*, vol. 3, pp. 3831-3833 (May 12-16, 1997).
Bloch, C. "The Midwest Proton Therapy Center" *Application of Accelerators in Research and Industry, Proceedings of the Fourteenth Int'l. Conf.*, Part Two, pp. 1253-1255 (Nov. 1996).
Blosser, H., et. al. "A Compact Superconducting Cyclotron for the Production of High Intensity Protons" *Proceedings of the 1997 Particle Accelerator Conference*, vol. 1, pp. 1054-1056 (May 12-16, 1997).
Blosser, H., et al., "Advances in Superconducting Cyclotrons at Michigan State University", Proceedings of the 11$^{th}$ International Conference on Cyclotrons and their Applications, pp. 157-167 (Oct. 1986), Tokyo.
Blosser, H., "Application of Superconductivity in Cyclotron Construction", *Ninth International Conference on Cyclotrons and their Applications*, pp. 147-157 (Sep. 1981).
Blosser, H. "Applications of Superconducting Cyclotrons" *Twelfth International Conference on Cyclotrons and Their Applications*, pp. 137-144 (May 8-12, 1989).
Blosser, H., et al., "Characteristics of a 400 (Q2/A) MeV Super-Conducting Heavy-Ion Cyclotron", Bulletin of the American Physical Society, p. 1026 (Oct. 1974).

(56) References Cited

OTHER PUBLICATIONS

Blosser, H. G. "Compact Superconducting Synchrocyclotron Systems for Proton Therapy" *Nuclear Instruments & Methods in Physics Research*, Section B40-41, Part II, pp. 1326-1330 (Apr. 1989).
Blosser, H.G., "Future Cyclotrons" AIP, *The Sixth International Cyclotron Conference*, pp. 16-32 (1972).
Blosser, H., et. al. "Medical Accelerator Projects at Michigan State Univ." *IEEE Proceedings of the 1989 Particle Accelerator Conference*, vol. 2, pp. 742-746 (Mar. 20-23, 1989).
Blosser, H.G., "Medical Cyclotrons", *Physics Today*, Special Issue Physical Review Centenary, pp. 70-73 (Oct. 1993).
Blosser, H., et al, National Superconducting Cyclotron Laboratory, Michigan State University, Report MSUCL-760.
Blosser, H., et al., "Preliminary Design Study Exploring Building Features Required for a Proton Therapy Facility for the Ontario Cancer Institute", MSUCL-760a (Mar. 1991).
Blosser, H., Present and Future Superconducting Cyclotrons, *Bulletin of the American Physical Society*, vol. 32, No. 2, p. 171 (Feb. 1987), Particle Accelerator Conference, Washington, D.C. 1987.
Blosser, H., et al., "Problems and Accomplishments of Superconducting Cyclotrons", Proceedings of the 14$^{th}$ International Conference, Cyclotrons and Their Applications, pp. 674-684 (Oct. 1995).
Blosser, H.G., "Program on the Coupled Superconducting Cyclotron Project", *Bulletin of the American Physical Society*, vol. 26, No. 4, p. 558 (Apr. 1981).
Blosser, H., et al., "Superconducting Cyclotron for Medical Application", *IEEE Transactions on Magnetics*, vol. 25, No. 2, pp. 1746-1754 (Mar. 1989).
Blosser, H.G., et al., "Superconducting Cyclotrons", Seventh International Conference on Cyclotrons and their Applications, pp. 584-594 (Aug. 19-22, 1975).
Blosser, H.G., "Superconducting Cyclotrons at Michigan State University", Nuclear Instruments & Methods in Physics Research, vol. B 24/25, part II, pp. 752-756 (1987).
Blosser, H. G. "Synchrocyclotron Improvement Programs" *IEEE Transactions on Nuclear Science USA*, vol. 16, No. 3, Part I, pp. 405-414 (Jun. 1969).
Blosser, H.G., "The Michigan State University Superconducting Cyclotron Program", Nuclear Science, vol. NS-26, No. 2, pp. 2040-2047 (Apr. 1979).
Botha, A. H., et. al. "A New Multidisciplinary Separated-Sector Cyclotron Facility" IEEE Transactions on Nuclear Science, vol. NS-24, No. 3, pp. 1118-1120 (1977).
Chichili, D.R., et al., "Fabrication of Nb3Sn Shell-Type Coils with Pre-Preg Ceramic Insulation," American Institute of Physics Conference Proceedings, AIP USA, No. 711, (XP-002436709, ISSN: 0094-243X), 2004, pp. 450-457.
Chong, C.Y., et al., Radiology Clinic North American 7, 3319 (1969).
Chu, et. al. "Instrumentation for Treatment of Cancer Using Proton and Light-ion Beams" Review of Scientific Instruments, 64 (8), pp. 2055-2122 (Aug. 1993).
Cole, et. al. "Design and Application of a Proton Therapy Accelerator", Fermi National Accelerator Laboratory, IEEE, 1985.
Conradie, et. al. "Proposed New Facilities for Proton Therapy at iThemba Labs" Proceedings of EPAC, pp. 560-562 (2002).
C/E Source of Ions for Use in Sychro-Cyclotrons Search, Jan. 31, 2005, 9 pages.
Source Search Cites of U.S. and Foreign Patents/Published applications in the name of Mitsubishi Denki Kabushiki Kaisha and Containing the Keywords (Proton and Synchrocyclotron), 8 pages.
Coupland, . "High-field (5 T) pulsed superconducting dipole magnet" Proceedings of the Institution of Electrical Engineers, vol. 121, No. 7, pp. 771-778 (Jul. 1974).
Coutrakon, et. al. "A prototype beam delivery system for the proton medical accelerator at Loma Linda" Medical Physics, vol. 18(6), pp. 1093-1099 (Nov./Dec. 1991).
Coutrakon, G et al. "Proton Synchrotrons for Cancer Therapy" Application of Accelerators in Research and Industry—Sixteenth International Conf., American Institute of Physics, vol. 576, pp. 861-864 (Nov. 1-5, 2000).
"CPAC Highlights Its Proton Therapy Program at ESTRO Annual Meeting", TomoTherapy Incorporated, Sep. 18, 2008, Madison, Wisconsin, pp. 1-2.
Cuttone, G., "Applications of a Particle Accelerators in Medical Physics" Istituto Nazionale di Fisica Nucleare-Laboratori Nazionali del Sud, V.S. Sofia, 44 Cantania, Italy (17 pages).
Dahl, P., "Superconducting Magnet System" American Institute of Physics, AIP Conference Proceedings, vol. 2, pp. 1329-1376 (1987-1988).
Dialog Search, Jan. 31, 2005 (18 pages).
Dugan, G. et al. "Tevatron Status" IEEE, Particle Accelerator Conference, Accelerator Science & Technology (1989), pp. 426-430.
Eickhoff, et al. "The Proposed Accelerator Facility for Light Ion Cancer Therapy in Heidelberg" Proceedings of the 1999 Particle Accelerator Conference, New York, pp. 2513-2515 (1999).
Enchevich, B. et al., "Minimizing Phase Losses in the 680 MeV Synchrocyclotron by Correcting the Accelerating Voltage Amplitude," *Atomnaya Energiya* 26:(3), pp. 315-316 (1969).
Endo, K., et. al., "Compact Proton and Carbon Ion Synchrotrons for Radiation Therapy" Proceedings of EPAC 2002, Paris France, pp. 2733-2735 (2002).
Flanz, et al., "Large Medical Gantries", 1995 Particle Accelerator Conference, Massachusetts General Hospital, pp. 1-5 (1995).
Flanz, et al., "The Northeast Proton Therapy Center at Massachusetts General Hospital", Fifth Workshop on Heavy Charge Particles in Biology and Medicine, GSI, Darmstadt (Aug. 1995).
Flanz, et. al. "Treating Patients with the NPTC Accelerator Based Proton Treatment Facility" Proceedings of the 2003 Particle Accelerator Conference (2003), pp. 690-693.
Flood, W. S. and Frazier, P. E. "The Wide-Band Driven RF System for the Berkeley 88-Inch Cyclotron" American Institute of Physics, Conference Proceedings., No. 9, 459-466 (1972).
Foster, G. W. and Kashikhin, V. S. "Superconducting Superferric Dipole Magent with Cold Iron Core for the VLHC" IEEE Transactions on Applied Superconductivity, vol. 12, No. 1, pp. 111-115 (Mar. 2002).
Friesel, D. L. et al. "Design and Construction Progress on the IUCF Midwest Proton Radiation Institute" Proceedings of EPAC 2002, pp. 2736-2738 (2002).
Fukumoto, "Cyclotron Versus Synchrotron for Proton Beam Therapy", KEK Prepr., No. 95-122, pp. 533-536 (1995).
Fukumoto, et. al., "A Proton Therapy Facility Plan" Cyclotrons and their Applications, Proceedings of the 13th International Conference, Vancouver, Canada, pp. 258-261 (Jul. 6-10, 1992).
Gordon, et. al. "Design Study for a Compact 200 MeV Cyclotron" AIP Conference Proceedings Sixth International Cyclotron Conference, No. 9, pp. 78-86 (1972).
Gordon, M. M., "Extraction Studies for a 250 MeV Superconducting Synchrocyclotron", Proceedings of the 1987 IEEE Particle Accelerator Conference: Accelerator Engineering and Technology, pp. 1255-1257 (1987).
Goto, A. et al., "Progress on the Sector Magnets for the Riken SRC," American Institute of Physics, CP600, Cyclotrons and Their Applications 2001, Sixteenth International Conference (2001), pp. 319-323.
Graffman, S., et al., Acta Radiol. Therapy Phys. Biol. 9, 1 (1970).
Graffman, et al. "Proton radiotherapy with the Uppsala cyclotron. Experience and plans" Strahlentherapie, 161, No. 12, pp. 764-770 (1985).
Graffman, et. al. "Design Studies for a 200 MeV Proton Clinic for Radiotherapy" AIP Conference Proceedings: Cyclotrons—1972, No. 9, pp. 603-615 (1972).
Hede, Karyn, "Research Groups Promoting Proton Therapy "Lite"", Journal of the National Cancer Institute, vol. 98, No. 23, Dec. 6, 2006, pp. 1682-1684.
Heinz, . "Superconducting Pulsed Magnetic Systems for High-Energy Synchrotrons" *Proceedings of the Fourth International Cryogenic Engineering Conference*, pp. 55-63. (May 24-26, 1972).

(56) References Cited

OTHER PUBLICATIONS

Hentschel, R., et. al., "Plans for the German National Neutron Therapy Centre with a Hospital-Based 70 MeV Proton Cyclotron at University Hospital Essen/Germany" *Cyclotrons and their Applications, Proceedings of the Fifteenth International Conference on Cyclotrons and their Applications*, Caen, Franco, pp. 21-23 (Jun. 14-19, 1998).
Hepburn, et. al. "Superconducting Cyclotron Neutron Source for Therapy" *International Journal of Radiation Oncology Biology Physics*, vol. 3 complete, pp. 387-391 (1977).
Hirabayashi, H. "Development of Superconducting Magnets for Beam Lines and Accelerator at KEK" *IEEE Transaction on Magnetics*, vol. Mag-17, No. 1, pp. 728-731 (Jan. 1981).
"Indiana's mega-million proton therapy cancer center welcomes its first patients" [online] Press release, Health & Medicine Week, 2004, retrieved from NewsRx.com, Mar. 1, 2004, pp. 119-120.
Ishibashi, K. and McInturff, A., "Stress Analysis of Superconducting 10T Magnets for Synchrotron", Proceedings of the Ninth International Cryogenic Engineering Conference, pp. 513-516 (May 11-14, 1982).
Ishibashi, K. and McInturff, A. "Winding Design Study of Superconducting 10 T Dipoles for a Synchrotron" *IEEE Transactions on Magnetics*, vol. MAG-19, No. 3, pp. 1364-1367 (May 1983).
Jahnke, A., et. al. "First Superconducting Prototype Magnets for a Compact Synchrotron Radiation Source in Operation" *IEEE Transactions on Magnetics*, vol. 24, No. 2 (Mar. 1988), pp. 1230-1232.
Jones, D.T.L. "Progress with the 200 MeV Cyclotron Facility at the National Accelerator Centre" *Commission of the European Communities Radiation Protection Proceedings, Fifth Symposium on Neutron Dosimetry*, vol. II, pp. 989-998 (Sep. 17-21, 1984).
Jones, D. T. L. "Present Status and Future Trends of Heavy Particle Radiotherapy" *Cyclotrons and their Applications 1998, Proceedings of the Fifteenth International Conference on Cyclotrons and their Applications*, pp. 13-20 (Jun. 14-19, 1998).
Jones, and Dershem . "Synchrotron Radiation from Proton in a 20 TEV, 10 TESLA Superconducting Super Collider" *Proceedings of the 12th International Conference on High-Energy Accelerators*, pp. 138-140 (Aug. 11-16, 1983).
Jones, D. T. L. and Mills, S. J. "The South African National Accelerator Centre: Particle Therapy and Isotope Production Programmes" *Radiation Physics and Chemistry*, vol. 51, Nos. 4-6, pp. 571-578 (Apr.-Jun. 1998).
Jones, D. T. L., et. al. "Status Report of the NAC Particle Therapy Programme" *Stralentherapie und Onkologie*, vol. 175, Suppl. II, pp. 30-32 (Jun. 1999).
Jongen, Y., et. al. "Progress report on the IBA-SHI small cyclotron for cancer therapy" *Nuclear Instruments and Methods in Physics Research*, Section B, vol. 79, issue 1-4, pp. 885-889 (1993).
Jongen, Y., et. al. "The proton therapy system for MGH's NPTC: equipment description and progress report" *Bulletin du Cancer/Radiotherapie, Proceedings of the meeting of the European Heavy Particle Therapy Group*, vol. 83, Suppl. 1, pp. 219-222 (1996).
Jongen, Y., et. al. "Development of a Low-cost Compact Cyclotron System for Proton Therapy" *National Institute of Radiol. Sci*,, No. 81, pp. 189-200 (1991).
Jongen, Y. et. al. "The proton therapy system for the NPTC: equipment description and progress report" *Nuclear Instruments and methods in Physics Research*, Section B, vol. 113, No. 1, pp. 522-525 (1996).
Kanai, et al., "Three-dimensional Beam Scanning for Proton Therapy," Nuclear Instruments and Methods in Physic Research, Sep. 1, 1983, The Netherlands, vol. 214, No. 23, pp. 491-496.
Karlin, D.L., et al., "Medical Radiology" (Moscow) 28, 13 (1983).
Karlin, D.L., et al., "The State and Prospects in the Development of the Medical Proton Tract on the Synchrocyclotron in Gatchina", Med. Radiol., Moscow, vol. 28(3), pp. 28-32 (Mar. 1983)(German with English Abstract on end of p. 32).
Kats, M.M. and Druzhinin, B.L. "Comparison of Methods for Irradiation Prone Patients" *Atomic Energy*, vol. 94, No. 2, pp. 120-123 (Feb. 2003).
Kats, M. M. and Onosovskii, K. K. "A Planar Magnetooptical System for the Irradiation of a Lying Patient with a Proton Beam from Various Directions" *Instruments and Experimental Techniques*, vol. 39, No. 1, pp. 127-131 (1996).
Kats, M. M. and Onosovskii, K. K. "A Simple, Compact, Flat System for the Irradiation of a Lying Patient with a Proton Beam from Different Directions" *Instruments and Experimental Techniques*, vol. 39, No. 1, pp. 132-134 (1996).
Koehler, A.M., et al., "Range Modulators for Protons and Heavy Ions," *Nuclear Instruments and Methods*, vol. 131, pp. 437-440 (1975).
Khoroshkov, V. S., et. al. "Moscow Hospital-Based Proton Therapy Facility Design" *Am. Journal Clinical Oncology: CCT*, vol. 17, No. 2, pp. 109-114 (Apr. 1994).
Kim, J. and Yun, C. "A Light-Ion Superconducting Cyclotron System for Multi-Disciplinary Users" *Journal of the Korean Physical Society*, vol. 43, No. 3, pp. 325-331 (Sep. 2003).
Kim, J.W., "An Eight Tesla Superconducting Magnet for Cyclotron Studies," Ph.D. Dissertation, Michigan State University, Department of Physics and Astronomy (1994).
Kim, J., et al., "Construction of 8T Magnet Test Stand for Cyclotron Studies", *IEEE Transactions on Applied Superconductivity*, vol. 3, No. 1, pp. 266-268 (Mar. 1993).
Kim, J., et al., "Design Study of a Superconducting Cyclotron for Heavy Ion Therapy", *Cyclotrons and Their Applications 2001, Sixteenth International Conference*, pp. 324-326 (May 13-17, 2001).
Kim, J. and Blosser, H., "Optimized Magnet for a 250 MeV Proton Radiotherapy Cyclotron", Cyclotrons and Their Applications 2001, *Sixteenth International Conference*, pp. 345-347 (May 2001).
Kim, J.W., et al., "Trim Coil System for the Riken Cyclotron Ring Cyclotron", *Proceedings of the 1997 Particle Accelerator Conference, IEEE*, vol. 3, pp. 214-235 (Dec. 1981). OR 3422-3424, 1998).
Kishida, N. and Yano, Y. "Beam Transport System for the RIKEN SSC (II)" *Scientific Papers of the Institute of Physical and Chemical Research*, vol. 75, No. 4, pp. 214-235 (Dec. 1981).
Koto, M. and Tsujii, H. "Future of Particle Therapy" *Japanese Journal of Cancer Clinics*, vol. 47, No. 1, pp. 95-98 (2001) [Lang.: Japanese], English abstract (http://sciencelinks.jp/j-east/article/200206/000020020601A0511453.php).
Kraft, G. et al., "Hadrontherapy in Oncology", U. Amaldi and Larrsson, editors Elsevier Science, 1994.
Krevet, et al, "Design of a Strongly Curved Superconducting Bending Magnet for a Compact Synchrotron Light Source", Advances in Cryogenic Engineering, vol. 33, pp. 25-32.
Larsson, B. "Biomedical Program for the Converted 200-MeV Synchrocyclotron at the Gustaf Werner Institute" *Radiation Research*, 104, pp. S310-S318 (1985).
Larsson, B., et al., Nature 182, 1222 (1958).
Lawrence, J.H., Cancer 10, 795 (1957).
Lawrence, J.H., et al., "Heavy particles in acromegaly and Cushing's Disease," in Endocrine and Norendocrine Hormone Producing Tumors (Year Book Medical Chicago, 1973), pp. 29-61.
Lawrence, J.H., et al., "Successful Treatment of Acromegaly: Metabolic and Clinical Studies in 145 Patients", The Journal of Clinical Endrocrinology and Metabolism, vol. 31, No. 2, Aug. 1970.
Lawrence, J.H., et al., Treatment of Pituitary Tumors, (Excerpta medica, Amsterdam/American Elsevier, New York, 1973), pp. 253-262.
Lecroy, W., et al., "Viewing Probe for High Voltage Pulses", *Review of Scientific Instruments USA* 31(12), p. 1354 (Dec. 1960).
Linfoot, J.A., et al., "Acromegaly," in Hormonal Proteins and Peptides, edited by C.H. Li, (1975), pp. 191-246.
Literature Author and Keyword Search, Feb. 14, 2005 (44 pages).
Literature Author and Keyword Searches (Synchrotron), Jan. 25, 2005 (78 pages).
Literature Keyword Search, Jan. 24, 2005 (96 pages).
Literature Search, Jan. 26, 2005 (36 pages).
Literature Search and Keyword Search for Synchrocyclotron, Jan. 25, 2005 (68 pages).
Literature Search by Company Name/Component Source, Jan. 24, 2005 (111 pages).

(56) References Cited

OTHER PUBLICATIONS

"LLNL, UC Davis Team Up to Fight Cancer", Lawrence Livermore National Laboratory, Apr. 28, 2006, SF-06-04-02, Livermore, California, pp. 1-4.
Mandrillon, P. "High Energy Medical Accelerators" *EPAC 90, 2nd European Particle Accelerator Conference*, vol. 2, (Jun. 12-16, 1990), pp. 54-58.
Marti, F., et al., "High Intensity Operation of a Superconducting Cyclotron", *Proceedings of the 14the International Conference, Cyclotrons and Their Applications*, pp. 45-48 (Oct. 1995).
Martin, P. "Operational Experience with Superconducting Synchrotron Magnets" *Proceedings of the 1987 IEEE Particle Accelerator Conference*, vol. 3 of 3, pp. 1379-1382 (Mar. 16-19, 1987).
Meot, F., et. al. "ETOILE Hadrontherapy Project, Review of Design Studies" *Proceedings of EPAC 2002*, pp. 2745-2747 (2002).
Miyamoto, S., et. al. "Development of the Proton Therapy System" *The Hitachi Hyoron*, vol. 79, 10, pp. 775-779 (1997) [Lang: Japanese], English abstract (http://www.hitachi.com/rev/1998/revfeb98/rev4706.htm).
Montelius, A., et. al. "The Narrow Proton Beam Therapy Unit at the Svedberg Laboratory in Uppsala" *ACTA Oncologica*, vol. 30, pp. 739-745 (1991).
Moser, H.O., et al., "Nonlinear Beam Optics with Real Fields in Compact Storage Rings", Nuclear Instruments & Methods in Physics Research/Section B, B30, Feb. 1988, No. 1, pp. 105-109.
National Cancer Institute Funding (Senate—Sep. 21, 1992) (www.thomas.loc.gov/cgi-bin/query/z?r102:S21SE2-712 (2 pages).
Nicholson, J. "Applications of Proton Beam Therapy" *Journal of the American Society of Radiologic Technologists*, vol. 67, No. 5, pp. 439-441 (May/Jun. 1996).
Nolen, J.A., et al., "The Integrated Cryogenic—Superconducting Beam Transport System Planned for MSU", *Proceedings of the 12th International Conference on High-Energy Accelerators*, pp. 549-551 (Aug. 1983).
Norimine, T., et. al. "A Design of a Rotating Gantry with Easy Steering for Proton Therapy" *Proceedings of EPAC 2002*, pp. 2751-2753 (2002).
Okumura, T., et. al. "Overview and Future Prospect of Proton Radiotherapy" *Japanese Journal of Cancer Clinics*, vol. 43, No. 2, pp. 209-214 (1997) [Lang.: Japanese].
Okumura, T., et. al. "Proton Radiotherapy" *Japanese Journal of Cancer and Chemotherapy*, 10. 20, No. 14, pp. 2149-2155 (1993) [Lang.: Japanese].
Outstanding from Search Reports, "Accelerator of Polarized Portons at Fermilab," 20 pages, 2005.
Palmer, R. and Tollestrup, A. V. "Superconducting Magnet Technology for Accelerators" *Annual Review of Nuclear and Particle Science*, vol. 34, pp. 247-284 (1984).
Patent Assignee and Keyword Searches for Synchrocyclotron, Jan. 25, 2005 (77 pages).
"Patent Assignee Search 'Paul Scherrer Institute," Library Services at Fish & Richardson P.C., Mar. 20, 2007 (40 pages).
"Patent Prior Art Search for 'Proton Therapy System'," Library Services at Fish & Richardson P.C., Mar. 20, 2007 (46 pages).
Pavlovic, M. "Beam-optics study of the gantry beam delivery system for light-ion cancer therapy" *Nuclear Instruments and Methods in Physics Research*, Section A, vol. 399, No. 2, pp. 439-454(16) (Nov. 1997).
Pedroni, E. "Accelerators for Charged Particle Therapy: Performance Criteria from the User Point of View" *Cyclotrons and their Applications, Proceedings of the 13th International Conference*, pp. 226-233 (Jul. 6-10, 1992).
Pedroni, E. "Latest Developments in Proton Therapy" *Proceedings of EPAC 2000*, pp. 240-244 (2000).
Pedroni, E., et. al. "The 200-MeV proton therapy project at the Paul Scherrer Institute: Conceptual design and practical realization" *Medical Physics*, vol. 22, No. 1, pp. 37-53 (Jan. 1995).
Pedroni, E., et. al. "A Novel Gantry for Proton Therapy at the Paul Scherrer Institute" *Cycloctrons and Their Applications 2001: Sixteenth International Conference. AIP Conference Proceedings*, vol. 600, pp. 13-17 (2001).
Pedroni, E. and Enge, H. "Beam optics design of compact gantry for proton therapy" *Medical & Biological Engineering & Computing*, vol. 33, No. 3, pp. 271-277 (May 1995).
Pedroni, E. and Jermann, M. "SGSMP: Bulletin Mar. 2002 Proscan Project, Progress Report on the PROSCAN Project of PSI" [online] retrieved from www.sgsmp.ch/protA23.htm, (5 pages) Mar. 2002.
Potts, R., et. al. "MPWP6-Therapy III: Treatment Aids and Techniques" *Medical Physics*, vol. 15, No. 5, p. 798 (Sep./Oct. 1988).
Pourrahimi, S. et al., "Powder Metallurgy Processed Nb3Sn(Ta) Wire for High Field NMR magnets," IEEE Transactions on Applied Superconductivity, vol. 5, No. 2, (Jun. 1995), pp. 1603-1606.
Prieels, D., et. al. "The IBA State-of-the-Art Proton Therapy System, Performances and Recent Results" *Application of Accelerators in Research and industry—Sixteenth Int 'l. Conf., American Institute of Physics*, vol. 576, pp. 857-860 (Nov. 1-5, 2000).
Rabin, M. S. Z., et. al. "Compact Designs for Comprehensive Proton Beam Clinical Facilities" *Nuclear Instruments & Methods in Physics Research*, Section B, vol. 40-41, Part II, pp. 1335-1339 (Apr. 1989).
Research & Development Magazine, "Proton Therapy Center Nearing Completion", vol. 41, No. 9, Aug. 1999 (2 pages)(www.rdmag.com).
RetroSearch "Berkeley 88-Inch Cyclotron 'RF' or 'Frequency Control'," Jan. 21, 2005 (36 pages).
RetroSearch "Berkeley 88-Inch Cyclotron," Jan. 24, 2005 (170 pages).
RetroSearch "Bernard Gottschalk, Cyclotron, Beams, Compensated Upstream Modulator, Compensated Scatter," Jan. 21, 2005 (20 pages).
RetroSearch "Cyclotron with 'RF' or 'Frequency Control'," Jan. 21, 2005 (49 pages).
RetroSearch Gottschalk, Bernard, Harvard Cyclotron Wheel, Jan. 21, 2005 (20 pages).
RetroSearch "Loma Linda University, Beam Compensation Foil Wedge," Jan. 21, 2005 (15 pages).
RetroSearch "Loma Linda University Beam Compensation," Jan. 21, 2005 (60 pages).
Revised Patent Keyword Search, Jan. 25, 2005 (88 pages).
Rifuggiato, D., et. al. "Status Report of the LNS Superconducting Cyclotron" *Nukleonika*, vol. 48, pp. S131-S134 (Supplement 2, 2003).
Rode, C. H. "Tevatron Cryogenic System" *Proceedings of the 12th International Conference on High-energy Accelerators, Fermilab*, pp. 529-535 (Aug. 11-16, 1983).
Salzburger, H., et al., "Superconducting Synchrotron Magnets Supraleitende Synchrotronmagnete", Siemens A.G., Erlangen (West Germany). Abteilung Technische Physik, Report No. BMFT-FB-T-75-25, Oct. 75, p. 147, Journal Announcement: GRAI7619; STAR1415, Subm-Sponsored by Bundesmin. Fuer Forsch. U. Technol. In German; English Summary.
Schillo, M., et. al. "Compact Superconducting 250 MeV Proton Cyclotron for the PSI Proscan Proton Therapy Project" *Cyclotrons and Their Applications 2001, Sixteenth International Conference*, pp. 37-39 (2001).
Schneider et al., "Superconducting Cyclotrons," IEEE Transactions on Magnetics, vol. MAG-11, No. 2, Mar. 1975, New York, pp. 443-446.
Schneider, R., et al., "Nevis Synchrocyclotron Conversion Program—RF System," *IEEE Transactions on Nuclear Science USA ns* 16(3) pp. 430-433 (Jun. 1969).
Schreuder, H.W. "Recent Developments in Superconducting Cyclotrons" *Proceedings of the 1995 Particle Accelerator Conference*, vol. 1, pp. 317-321 (May 1-5, 1995).
Schreuder, A. N., et. al. "The Non-orthogonal Fixed Beam Arrangement for the Second Proton Therapy Facility at the National Accelerator Centre" *Application of Accelerators in Research and Industry, American Institute of Physics, Proceedings of the Fifteenth International Conference*, Part Two, pp. 963-966 (Nov. 1998).

(56) References Cited

OTHER PUBLICATIONS

Schubert, J. R. "Extending the Feasibility Boundary of the Isochronous Cyclotron" Dissertation submitted to Michigan State University, 1997, Abstract http://adsabs.harvard.edu/abs/1998PhDT.....147S.
Schubert, J. and Blosser, H. "Conceptual Design of a High Field Ultra-Compact Cyclotron for Nuclear Physics Research" *Proceedings of the 1997 Particle Accelerator Conference*, vol. 1, pp. 1060-1062 (May 12-16, 1997).
Shelaev, I. A., et. al. "Design Features of a Model Superconducting Synchrotron of JINR" *Proceedings of the 12th International Conference on High-energy Accelerators*, pp. 416-418 (Aug. 11-16, 1983).
Shintomi, T., et. al. "Technology and Materials for the Superconducting Super Collider (SSC) Project" [Lang.: Japanese], The Iron and Steel Institute of Japan 00211575, vol. 78, No. 8 (19920801), pp. 1305-1313, http://ci.nii.ac.jp/naid/110001493249/en/ , 1992.
Sisterson, J. M. "World Wide Proton Therapy Experience in 1997" *The American Insitute of Physics, Applications of Accelerators in Research and Industry, Proceedings of the Fifteenth International Conference*, Part Two, pp. 959-962 (Nov. 1998).
Sisterson, J. M. "Clinical Use of Proton and Ion Beams From a World-Wide Perspective" *Nuclear Instruments and Methods in Physics Research*, Section B, vol. 40-41, pp. 1350-1353 (1989).
Slater, J. M., et. al. "Development of a Hospital-Based Proton Beam Treatment Center" *International Journal of Radiation Oncology Biology Physics*, vol. 14, No. 4, pp. 761-775 (Apr. 1988).
Slater, J. M., et. al. "Developing a Clinical Proton Accelerator Facility: Consortium-Assisted Technology Transfer" *Conference Record of the 1991 IEEE Particle Accelerator Conference: Accelerator Science and Technology*, vol. 1, pp. 532-536 (May 6-9, 1991).
Smith, A., et. al. "The Northeast Proton Therapy Center at Massachusetts General Hospital" *Journal of Brachytherapy International*, pp. 137-139 (Jan. 1997).
Snyder, S. L. and Marti, F. "Central region design studies for a proposed 250 MeV proton cyclotron" *Nuclear Instruments and Methods in Physics Research*, Section A, vol. 355, pp. 618-623 (1995).
Soga, F. "Progress of Particle Therapy in Japan" *Application of Accelerators in Research and Industry, American Institute of Physics, Sixteenth International Conference*, pp. 869-872 (Nov. 2000).
Spiller, P., et. al. "The GSE Synchrotron Facility Proposal for Acceleration of High Intensity Ion and Proton Beams" *Proceedings of the 2003 Particle Accelerator Conference*, vol. 1, pp. 589-591 (May 12-16, 2003).
Stanford, A.L., et al., "Method of Temperature Control in Microwave Ferroelectric Measurements," Sperry Microwave Electronics Company, Clearwater, Florida, Sep. 19, 196 (1 page).
Superconducting Cyclotron Contract awarded by Paul Scherrer Institute (PSI), Villigen, Switzerland, http://www.accel.de/News/superconducting_cyclotron_contract.html Feb. 3, 2005.
Tadashi, I., et al., "Large superconducting super collider (SSC) in the planning and materials technology", vol. 78, No. 8 (19920801), pp. 1305-1313, The Iron and Steel Institute of Japan 00211575.
Takada, Yoshihisa Tsukumba, "A review of rotating gantries for heavy charged particle therapy," Symposium of Research Center for Charged Particle Therapy on Fundamental development of the charged particle therapy, Chiba (Japan), Nov. 13-14, 2001.
Takada, Y. "Conceptual Design of a Proton Rotating Gantry for Cancer Therapy" *Japanese Journal of Medical Physics*, vol. 15, No. 4, pp. 270-284 (1995).
Takayama, T., et al., "Compact Cyclotron for Proton Therapy," *Proceedings of the 8th Symposium on Accelerator Science and Technology*, Japan (Nov. 25-27, 1991) pp. 380-382.
Teng, L. C. "The Fermilab Tevatron" *Coral Gables 1981, Proceedings, Gauge Theories, Massive Neutrinos, and Proton Decay*, pp. 43-62 (1981).
"The Davis 76-Inch Isochronous Cyclotron", Beam On: Crocker Nuclear Laboratory, University of California.
The Journal of Practical Pharmacy, vol. 46, No. 1, 1995, pp. 97-103. [Japanese].
"The K100 Neutron-therapy Cyclotron," National Superconducting Cyclotron Laboratory at Michigan State University (NSCL), retrieved from: http://www.nscl.msu.edu/tech/accelerators/k100, Feb. 2005.
"The K250 Proton therapy Cyclotron," National Superconducting Cyclotron Laboratory at Michigan State University (NSCL), retrieved from: http://www.nscl.msu.edu/tech/accelerators/k250.html , Feb. 2005.
"The K250 Proton-therapy Cyclotron Photo Illustration," National Superconducting Cyclotron Laboratory at Michigan State University (NSCL), retrieved from: http://www.nscl.msu.edu/media/image/experimental-equipment-technology/250.html , Feb. 2005.
Tobias, C.A., et al., Cancer Research 18, 121 (1958).
Tom, J. L. "The Use of Compact Cyclotrons for Producing Fast Neutrons for Therapy in a Rotatable Isocentric Gantry" *IEEE Transaction on Nuclear Science*, vol. 26, No. 2, pp. 2294-2298 (Apr. 1979).
Toyoda, E., "Proton Therapy System", Sumitomo Heavy Industries, Ltd.
Trinks, U., et. al. "The Tritron: A Superconducting Separated-Orbit Cyclotron" *Nuclear Instruments and Methods in Physics Research*, Section A, vol. 244, pp. 273-282 (1986).
Tsuji, H., "Cancer Therapy by Proton Beam: Latest State and Future Prospects", *Isotope News*, No. 459, pp. 2-7 (1992).
Tsuji, H. "The Future and Progress of Proton Beam Radiotherapy" *Journal of Japanese Society for Therapeutic Radiology and Oncology*, vol. 6, No. 2, pp. 63-76 (1994).
UC Davis School of Medicine, "Unlikely Partners Turn Military Defense into Cancer Offense", Current Issue Summer 2008, Sacramento, California, pp. 1-2.
Umegaki, K., et. al. "Development of an Advanced Proton Beam Therapy System for Cancer Treatment" *Hitachi Hyoron*, vol. 85, No. 9, pp. 605-608 (2003) [Lang.: Japanese], English abstract, http://www.hitachi.com/ICSFiles/afieldfile/2004/06/01/r2003_04_104.pdf or http://www.hitachi.com/rev/archive/2003/2005649_12606.html (full text) [Hitachi, vol. 52, No. 4 Dec. 2003].
Umezawa, M., et. al. "Beam Commissioning of the new Proton Therapy System for University of Tsukuba" *Proceedings of the 2001 Particle Accelerator Conference*, vol. 1, pp. 648-650 (Jun. 18-22, 2001).
van Steenbergen, A. "The CMS, a Cold Magnet Synchrotron to Upgrade the Proton Energy Range of the BNL Facility" *IEEE Transactions on Nuclear Science*, vol. 18, Issue 3, pp. 694-698 (Jun. 1971).
van Steenbergen, A. "Superconducting Synchroton Development at BNL" *Proceedings of the 8th International Conference on High-Energy Accelerators CERN 1971*, pp. 196-198 (1971).
Vandeplassche, D., et. al. "235 MeV Cyclotron for MGH's Northeast Proton Therapy Center (NPTC): Present Status" EPAC 96, *Fifth European Partical Accelerator Conference*, vol. 3, pp. 2650-2652 (Jun. 10-14, 1996).
Vorobiev, L.G., et al., "Concepts of a Compact Achromatic Proton Gantry with a Wide Scanning Field", Nuclear Instruments and Methods in Physics Research, Section A., vol. 406, No. 2, pp. 307-310 (1998).
Vrenken, H., et. al. "A Design of a Compact Gantry for Proton Therapy with 2D-Scanning" *Nuclear Instruments and Methods in Physics Research*, Section A, vol. 426, No. 2, pp. 618-624 (1999).
Wikipedia, "Cyclotron" http://en.wikipedia.org/wiki/Cyclotron (originally visited Oct. 6, 2005, revisited Jan. 28, 2009)(7 pages).
Wikipedia, "Synchrotron" http://en.wikipedia.org/wiki/Synchrotron (originally visited Oct. 6, 2005, revisited Jan. 28, 2009)(7 pages).
Worldwide Patent Assignee Search, Jan. 24, 2005 (224 pages).
Worldwide Patent Keyword Search, Jan. 24, 2005 (94 pages).
Wu, X., "Conceptual Design and Orbit Dynamics in a 250 MeV Superconducting Synchrocyclotron," Ph.D. Dissertation, Michigan State University, Department of Physics and Astronomy (1990).
York, R.C., et al., "Present Status and Future Possibilities at NSCL-MSU", EPAC 94, Fourth European Particle Accelerator Conference, pp. 554-556 (Jun. 1994).
York, R.C., et al., "The NSCL Coupled Cyclotron Project—Overview and Status", *Proceedings of the Fifteenth International Conference on Cyclotrons and their Applications*, pp. 687-691 (Jun. 1998).
Yudelev, M., et. al. "Hospital Based Superconducting Cyclotron for Neutron Therapy: Medical Physics Perspective" *Cyclotrons and their*

(56) References Cited

OTHER PUBLICATIONS

*applications 2001, 16th International Conference. American Institute of Physics Conference Proceedings*, vol. 600, pp. 40-43 (May 13-17, 2001) http://www.osti.gov/energycitations/product.biblio.jsp?osti_id=20468164, http://adsabs.harvard.edu/abs/2001AIPC..600...40Y, http://scitation.aip.org/getabs/servlet/GetabsServlet?prog=normal&id=ACPCS000600000001000004000001&idtype=cvips&gifs=yes.
Zherbin, E. A., et al., "Proton Beam Therapy at the Leningrad Synchrocyclotron (Clinicomethodological Aspects and Therapeutic Results)", pp. 17-22, Aug. 1987, vol. 32(8)(German with English abstract on pp. 21-22).
18th Japan Conference on Radiation and Radioisotopes [Japanese], Nov. 25-27, 1987, 9 pages.
"510(k) Summary: Ion Beam Applications S.A.", FDA, Apr. 13, 2001.
"510(k) Summary: Optivus Proton Beam Therapy System", Jul. 21, 2000, 5 pages.
Office action and response history of U.S. Appl. No. 11/601,056 up to Jan. 14, 2010.
Livingston, M. S., et. al. "A Capillary Ion Source for the Cyclotron" *Review Science Instruments*, vol. 10:63, pp. 63-67, (Feb. 1939).
International Preliminary Report on Patentability from PCT application No. PCT/US2008/084695, mailed Jun. 10, 2010 (10 pages).
International Preliminary Report on Patentability from PCT application No. PCT/US2008/084699, mailed Jun. 10, 2010 (8 pages).
International Preliminary Report on Patentability from PCT application No. PCT/US2007/086109, mailed Jun. 10, 2010 (7 pages).
European Patent Office communication from European application No. 07868958.5, mailed Jul. 16, 2010 (2 pages).
Voluntary amendment filed Apr. 18, 2011 in corresponding Chinese application No. CN200780102281.X , including English translation of claim amendments (10 pages).
Non Final Office Action from U.S. Appl. No. 12/618,297 mailed May 13, 2011 (44 pages).
Response to Office Action issued Aug. 20, 2010 in U.S. Appl. No. 11/948,359, filed Feb. 22, 2011 (17 pages).
Non Final Office Action from U.S. Appl. No. 11/948,359 mailed Aug. 20, 2010 (12 pages).
Non Final Office Action from U.S. Appl. No. 12/275,103 mailed Feb. 1, 2011 (6 pages).
Response to Non Final Office Action issued Feb. 1, 2011 in U.S. Appl. No. 12/275,103, filed May 2, 2011 (13 pages).
European Search Report from corresponding European application No. 11165422.4 mailed Aug. 8, 2011 (118 pages).
European Search Report from corresponding European application No. 11165423.2 mailed Aug. 8, 2011 (118 pages).
European Communication from corresponding European application No. 11165422.4 mailed Sep. 2, 2011 (5 pages).
European Communication from corresponding European application No. 11165423.2 mailed Sep. 2, 2011 (5 pages).
Chinese Office action from Chinese application No. 200680051421.0 issued Aug. 22, 2011 (4 pages).
Chinese Office action from Chinese application No. 200680051421.0 issued Mar. 21, 2011 (6 pages).
Chinese Office action from Chinese application No. 200680051421.0 issued Dec. 25, 2009 (8 pages).
Canadian Office action from Canadian application No. 2,629,333 issued May 11, 2011 (2 pages).
Canadian Office action from Canadian application No. 2,629,333 issued Aug. 30, 2010 (5 pages).
European Communication from European application No. 06838033.6 mailed Apr. 20, 2010 (7 pages).
European Patent Office communication from European application No. 08855024.9, mailed Jul. 30, 2010 (2 pages).
European Patent Office communication from European application No. 08856764.9, mailed Jul. 30, 2010 (2 pages).
Chinese Office action from Chinese application No. 200880125918.1, mailed Sep. 15, 2011 (111 pages).
Chinese Office action from Chinese application No. 200880125832.9, mailed Sep. 22, 2011 (11 pages).
Response to Chinese Office action of Jan. 25, 2010 in Chinese application No. 200680051421.0, filed Jun. 24, 2010 (34 pages).
Office action from U.S. Appl. No. 11/948,359, mailed Aug. 20, 2010 (12 pages).
Response to European Communication of Apr. 20, 2010, from European application No. 06838033.6, filed Nov. 2, 2010 (13 pages).
European Communication from European application No. 07868958.5, mailed Nov. 26, 2010 (50 pages).
Response to European Communication of Jul. 16, 2010 in European application No. 07868958.5 filed Aug. 26, 2010 (9 pages).
Response to European Communication of Nov. 26, 2010 in European application No. 07868958.5, filed Mar. 28, 2011 (9 pages).
Japanese Office action from corresponding Japanese application No. 2010-536130 issued Jun. 4, 2013 (8 pages).
Timmer, Jan, "The ACCEL Single Room Proton Therapy Facility" ACCEL Instruments GmbH, PTCOG 45, Oct. 7-11, 2006, Houston, Texas (18 pages).
Renner, T.R., et al., "Preliminary Results of a Raster Scanning Beam Delivery System", IEEE, 1989 (3 pages).
Pardo, J., et al., "Simulation of the Performance of the CNAO facility's Beam Delivery System", PTCOG 46, Zibo, China, May 21, 2007 (17 pages).
"Single Room Proton Therapy Facility", ACCEL, Oct. 2006 (1 page).
Flanz, J, et al., "Scanning Beam Technologies", PTCOG 2008 (28 pages).
Lin, S., et al., "Principles and 10 Year Experience of the Beam Monitor System at the PSI Scanned Proton Therapy Facility", Center for Proton Radiation Therapy, Paul Scherrer Institute, CH-5232 Villigen PSI, Switzerland, 2007 (21 pages).
Schubert and Blosser, "Progress Toward an Experiment to Study the Effect of RF Grounding in an Internal Ion Source on Axial Oscillations of the Beam in a Cyclotron", National Superconducting Cyclotron Laboratory, Michigan State University, Report MSUCL-760, CP600, Cyclotrons and Their Applications 2001, Sixteenth International Conference, 2001 pp. 274-276.
Cuttone, G., "Applications of a Particle Accelerators in Medical Physics" Istituto Nazionale di Fisica Nucleare-Laboratori Nazionali del Sud, V.S. Sofia, 44 Cantania, Italy, Jan. 2010 (17 pages).
Source Search Cites of U.S. And Foreign Patents/Published applications in the name of Mitsubishi Denki Kabushiki Kaisha and Containing the Keywords (Proton and Synchrocyclotron), Jan. 2005, 8 pages.
Flanz, et al., "Operation of a Cyclotron Based Proton Therapy Facility", Massachusetts General Hospital, Boston, MA, 2010, pp. 1-4.
Krevet, et al, "Design of a Strongly Curved Superconducting Bending Magnet for a Compact Synchrotron Light Source", Advances in Cryogenic Engineering, vol. 33, pp. 25-32, 1988.
Salzburger, H., et al., "Superconducting Synchrotron Magnets Supraleitende Synchrotronmagnete", Siemens A.G., Erlangen (West Germany). Abteilung Technische Physik, Report No. BMFT-FN-T-75-25, Oct. 1975, p. 147, Journal Announcement: GRAI7619; STAR1415, Subm-Sponsored by Bundesmin. Fuer Forsch. U. Technol. In German; English Summary.
Stanford, A.L., et al., "Method of Temperature Control in Microwave Ferroelectric Measurements," Sperry Microwave Electronics Company, Clearwater, Florida, Sep. 19, 1960 (1 page).
Tadashi, I., et al., "Large superconducting super collider (SSC) in the planning and materials technology", vol. 78, No. 8 (Aug. 1992), pp. 1305-1313, The Iron and Steel Institute of Japan 00211575.
"The Davis 76-Inch Isochronous Cyclotron", Beam On: Crocker Nuclear Laboratory, University of California, Feb. 9, 2009 (1 page).
Toyoda, E., "Proton Therapy System", Sumitomo Heavy Industries, Ltd., 2000.
Badano et al., Proton-Ion Medical Machine Study (PIMMS) Part I, PIMMS, Jan. 1999, 238 pages.
"Beam Delivery and Properties" Journal of the ICRU, vol. 7 No. 2, 2007, 20 pages.
Peggs et al. "A Survey of Hadron Therapy Accelerator Technologies" Particle Accelerator Conference, Jun. 25-29-, 2007, 7 pages.
Pedroni et al., "Latest Developments in Proton Therapy" Proceedings of EPAC, Vienna Austria, 2000, 5 pages.

(56) References Cited

OTHER PUBLICATIONS

Collins, et al., "The Indiana University Proton Therapy System", Proceedings of EPAC 2006, Edinburgh, Scotland, 3 pages.
Paganetti et al., "Proton Beam Radiotherapy—The State of the Art" Springer Verlag, Heidelberg, ISBN 3-540-00321-5, Oct. 2005, 36 pages.
Pedroni, "Status of Proton Therapy: results and future trends" Paul Scherrer Institute, Division of Radiation Medicine, 5 pages, 2007.
Kimstrand, "Beam Modelling for Treatment Planning of Scanned Proton Beams" Digital Comprehensive Summaries of Uppsala dissertations from the Faculty of Medicine 330, Uppsala Universitet, 2008, 58 pages.
Marchand et al., "IBA Proton Pencil Beam Scanning: an Innovative Solution for Cancer Treatement", Proceedings of EPAC 2000, Vienna, Austria, 3 pages.
Alonso, "Magnetically Scanned Ion Beams for Radiation Therapy" Accelerator & Fusion Research Division, Lawrence Berkeley Laboratory, Berkeley, CA, Oct. 1988, 13 pages.
Moyers et al., "A Continuously Variable Thickness Scatterer for Proton Beams Using Self-compensating Dual Linear Wedges" Loma Linda University Medical Center, Dept. of Radiation Medicine, Loma Linda, CA, Nov. 2, 1992, 21 pages.
Chu et al., "Performance Specifications for Proton Medical Facility" , Lawrence Berkeley Laboratory, University of California, Mar. 1993, 128 pages.
Chu, "Instrumentation in Medical Systems" Accelerator and Fusion Research Division, Lawrence Berkeley Laboratory, University of California, Berkeley, CA, May 1995, 9 pages.
Tilly et al., "Development and verification of the pulsed scanned proton beam at The Svedberg Laboratory in Uppsala", Phys. Med. Biol. 52, 2007, pp. 2741-2754.
Bimbot, "First Studies of the Extenral Beam from the Orsay S.C. 200 MeV" Institut de Physique Nucleaire, BP 1, Orsay, France, IEEE, 1979, pp. 1923-1926.
Cosgrove et al., "Microdosimetric Studies on the Orsay Proton Synchrocyclotron at 73 and 200 MeV", Radiation Protection Dosimetry, vol. 70, Nos. 1-4, pp. 493-496, 1997.
Laisne et al., "The Orsay 200 MeV Synchrocyclotron" IEEE Transactions on Nuclear Science, vol. NS-26, No. 2, Apr. 1979, pp. 1919-1922.
Lin et al., "Principles and 10 year experience of the beam monitor system at the psi scannned proton therapy facility" Center for Proton Radiation Therapy, Paul Scherrer Institute, Switzerland, 21 pages, 2007.
Chinese Office Action for Chinese application 200880125918.1 mailed Sep. 15, 2011 (15pages).
Response to Chinese Office Action mailed Sep. 15, 2011 in Chinese application 200880125918.1, filed Mar. 29, 2012 (26 pages).
Chinese Office Action for Chinese application 200880125918.1 mailed May 30, 2012 (10 pages).
Response to Chinese Office Action mailed May 30, 2012 in Chinese application 200880125918.1, filed Aug. 14, 2012 (19 pages).
Chinese Office Action for Chinese application 200880125918.1 mailed Dec. 7, 2012 (10 pages).

* cited by examiner

INTERRUPTED PARTICLE SOURCE

TECHNICAL FIELD

This patent application describes a particle accelerator having a particle source that is interrupted at an acceleration region.

BACKGROUND

In order to accelerate charged particles to high energies, many types of particle accelerators have been developed. One type of particle accelerator is a cyclotron. A cyclotron accelerates charged particles in an axial magnetic field by applying an alternating voltage to one or more dees in a vacuum chamber. The name dee is descriptive of the shape of the electrodes in early cyclotrons, although they may not resemble the letter D in some cyclotrons. The spiral path produced by the accelerating particles is perpendicular to the magnetic field. As the particles spiral out, an accelerating electric field is applied at the gap between the dees. The radio frequency (RF) voltage creates an alternating electric field across the gap between the dees. The RF voltage, and thus the field, is synchronized to the orbital period of the charged particles in the magnetic field so that the particles are accelerated by the radio frequency waveform as they repeatedly cross the gap. The energy of the particles increases to an energy level greatly in excess of the peak voltage of the applied RF voltage. As the charged particles accelerate, their masses grow due to relativistic effects. Consequently, the acceleration of the particles varies the phase match at the gap.

Two types of cyclotrons presently employed, an isochronous cyclotron and a synchrocyclotron, overcome the challenge of increase in relativistic mass of the accelerated particles in different ways. The isochronous cyclotron uses a constant frequency of the voltage with a magnetic field that increases with radius to maintain proper acceleration. The synchrocyclotron uses a decreasing magnetic field with increasing radius to provide axial focusing and varies the frequency of the accelerating voltage to match the mass increase caused by the relativistic velocity of the charged particles.

SUMMARY

In general, this patent application describes a synchrocyclotron comprising magnetic structures to provide a magnetic field to a cavity, and a particle source to provide a plasma column to the cavity. The particle source has a housing to hold the plasma column. The housing is interrupted at an acceleration region to expose the plasma column. A voltage source is configured to provide a radio frequency (RF) voltage to the cavity to accelerate particles from the plasma column at the acceleration region. The synchrocyclotron described above may include one or more of the following features, either alone or in combination.

The magnetic field may be above 2 Tesla (T), and the particles may accelerate from the plasma column outwardly in spirals with radii that progressively increase. The housing may comprise two portions that are completely separated at the acceleration region to expose the plasma column. The voltage source may comprise a first dee that is electrically connected to an alternating voltage and a second dee that is electrically connected to ground. At least part of the particle source may pass through the second dee. The synchrocyclotron may comprise a stop in the acceleration region. The stop may be for blocking acceleration of at least some of the particles from the plasma column. The stop may be substantially orthogonal to the acceleration region and may be configured to block certain phases of particles from the plasma column.

The synchrocyclotron may comprise cathodes for use in generating the plasma column. The cathodes may be operable to pulse a voltage to ionize gas to generate the plasma column. The cathodes may be configured to pulse at voltages between about 1 kV to about 4 kV. The cathodes need not be heated by an external heat source. The synchrocyclotron may comprise a circuit to couple voltage from the RF voltage to the at least one of the cathodes. The circuit may comprise a capacitive circuit.

The magnetic structures may comprise magnetic yokes. The voltage source may comprise a first dee that is electrically connected to an alternating voltage and a second dee that is electrically connected to ground. The first dee and the second dee may form a tunable resonant circuit. The cavity to which the magnetic field is applied may comprise a resonant cavity containing the tunable resonant circuit.

In general, this patent application also describes a particle accelerator comprising a tube containing a gas, a first cathode adjacent to a first end of the tube, and a second cathode adjacent to a second end of the tube. The first and second cathodes are for applying voltage to the tube to form a plasma column from the gas. Particles are available to be drawn from the plasma column for acceleration. A circuit is configured to couple energy from an external radio frequency (RF) field to at least one of the cathodes. The particle accelerator described above may include one or more of the following features, either alone or in combination.

The tube may be interrupted at an acceleration region at which the particles are drawn from the plasma column. The first cathode and the second cathode need not be heated by an external source. The first cathode may be on a different side of the acceleration region than the second cathode.

The particle accelerator may comprise a voltage source to provide the RF field. The RF field may be for accelerating the particles from the plasma column at the acceleration region. The energy may comprise a portion of the RF field provided by the voltage source. The circuit may comprise a capacitor to couple energy from the external field to at least one of the first cathode and the second cathode.

The tube may comprise a first portion and a second portion that are completely separated at a point of interruption at the acceleration region. The particle accelerator may comprise a stop at the acceleration region. The stop may be used to block at least one phase of the particles from further acceleration.

The particle accelerator may comprise a voltage source to provide the RF field to the plasma column. The RF field may be for accelerating the particles from the plasma column at the acceleration region. The RF field may comprise a voltage that is less than 15 kV. Magnetic yokes may be used to provide a magnetic field that crosses the acceleration region. The magnetic field may be greater than about 2 Tesla (T).

In general, this patent application also describes a particle accelerator comprising a Penning ion gauge (PIG) source comprising a first tube portion and a second tube portion that are at least partially separated at an acceleration region. The first tube portion and the second tube portion are for holding a plasma column that extends across the acceleration region. A voltage source is used to provide a voltage at the acceleration region. The voltage is for accelerating particles out of the plasma column at the acceleration region. The particle accelerator described above may include one or more of the following features, either alone or in combination.

The first tube portion and the second tube portion may be completely separated from each other. Alternatively, only one or more portions of the first tube portion may be separated from corresponding portions of the second tube portion. In this latter configuration, the PIG source may comprise a physical connection between a part of the first tube portion and the second tube portion. The physical connection may enable particles accelerating out of the plasma column to complete a first turn upon escaping from the plasma column without running into the physical connection.

The PIG source may pass through a first dee that is electrically connected to ground. A second dee that is electrically connected to an alternating voltage source may provide the voltage at the acceleration region.

The particle accelerator may comprise a structure that substantially encloses the PIG source. The particle accelerator may comprise magnetic yokes that define a cavity containing the acceleration region. The magnetic yokes may be for generating a magnetic field across the acceleration region. The magnetic field may be at least 2 Tesla (T). For example, the magnetic field may be at least 10.5 T. The voltage may comprise a radio frequency (RF) voltage that is less than 15 kV.

The particle accelerator may comprise one or more electrodes for use in accelerating the particles out of the particle accelerator. At least one cathode may be used in generating the plasma column. The at least one cathode used in generating the plasma column may comprise a cold cathode (e.g., one that is not heated by an external source). A capacitive circuit may couple at least some of the voltage to the cold cathode. The cold cathode may be configured to pulse voltage to generate the plasma column from gas in the first tube portion and the second tube portion.

Any of the foregoing features may be combined to form implementations not specifically described herein.

The details of one or more examples are set forth in the accompanying drawings and the description below. Further features, aspects, and advantages will become apparent from the description, the drawings, and the claims.

DETAILED DESCRIPTION

A synchrocyclotron-based system is described herein. However, the circuits and methods described herein may used with any type of cyclotron or particle accelerator.

Figure 1A:
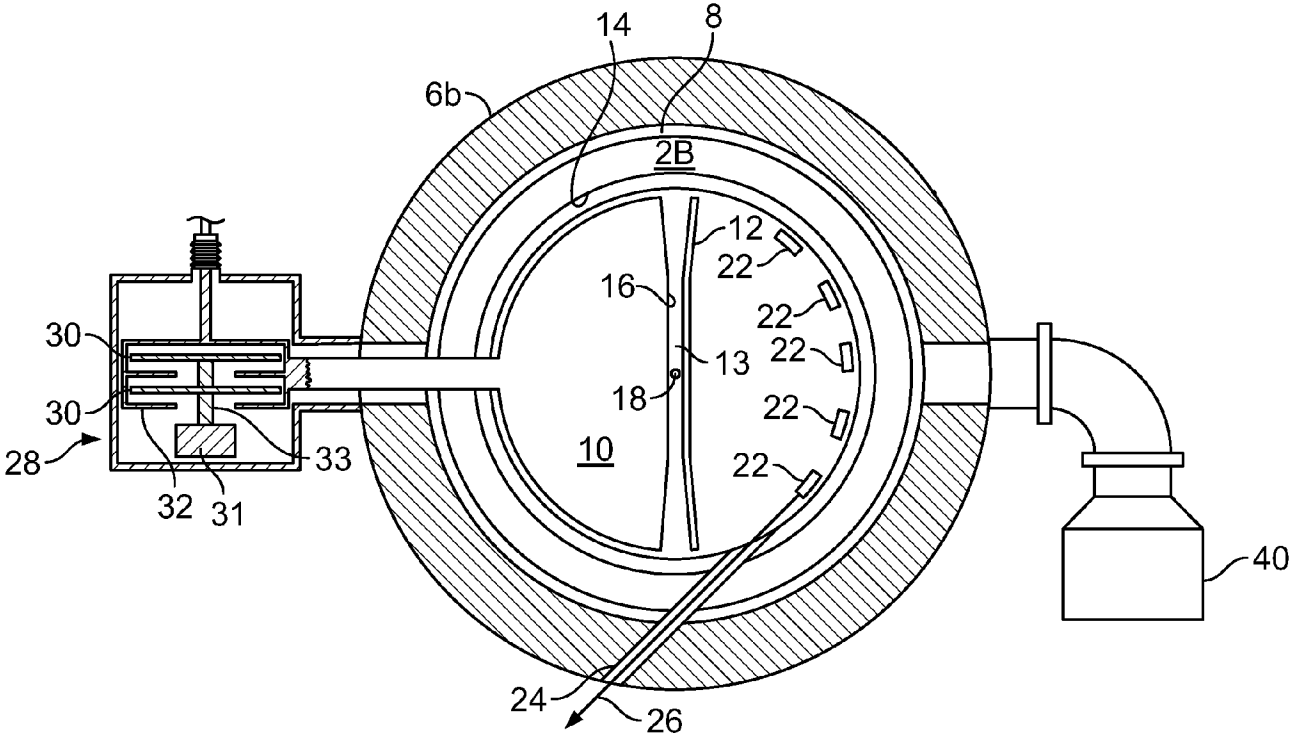
FIG. 1A is a cross-sectional view of a synchrocyclotron.
Figure 1B:
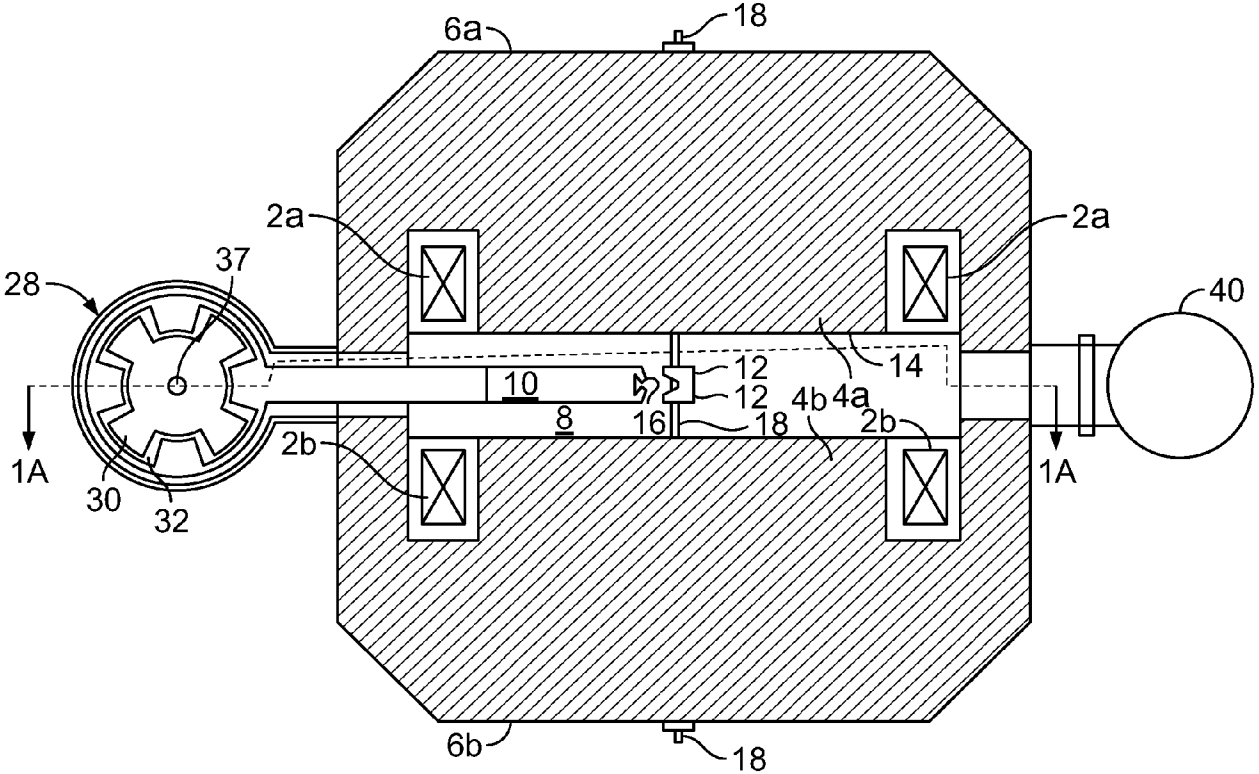
FIG. 1B is a side cross-sectional view of the synchrocyclotron shown in FIG. 1A.

Referring to FIGS. 1A and 1B, a synchrocyclotron 1 includes electrical coils 2*a* and 2*b* around two spaced apart ferro-magnetic poles 4*a* and 4*b*, which are configured to generate a magnetic field. Magnetic poles 4*a* and 4*b* are defined by two opposing portions of yokes 6*a* and 6*b* (shown in cross-section). The space between poles 4*a* and 4*b* defines vacuum chamber 8 or a separate vacuum chamber can be installed between poles 4*a* and 4*b*. The magnetic field strength is generally a function of distance from the center of vacuum chamber 8 and is determined largely by the choice of geometry of coils 2*a* and 2*b* and the shape and material of magnetic poles 4*a* and 4*b*.

The accelerating electrodes are defined as dee 10 and dee 12, having gap 13 between them. Dee 10 is connected to an alternating voltage potential whose frequency is changed from high to low during an accelerating cycle in order to account for the increasing relativistic mass of a charged particle and radially decreasing magnetic field (measured from the center of vacuum chamber 8) produced by coils 2*a* and 2*b* and pole portions 4*a* and 4*b*. Accordingly, dee 10 is referred to as the radio frequency (RF) dee. The idealized profile of the alternating voltage in dees 10 and 12 is show in FIG, 2 and will be discussed in detail below. In this example, RF dee 10 is a half-cylinder structure, which is hollow inside. Dee 12, also referred to as the "dummy dee", does not need to be a hollow cylindrical structure, since it is grounded at the vacuum chamber walls 14. Dee 12, as shown in FIGS. 1A and 1B, includes a strip of metal, e.g., copper, having a slot shaped to match a substantially similar slot in RF dee 10. Dee 12 can be shaped to form a mirror image of surface 16 of RF dee 10.

Ion source 18 is located at about the center of vacuum chamber 8, and is configured to provide particles (e.g., protons) at a center of the synchrocyclotron for acceleration, as described below. Extraction electrodes 22 direct the charged particles from an acceleration region into extraction channel 24, thereby forming beam 26 of the charged particles. Here, ion source 18 is inserted axially into the acceleration region.

Dees 10 and 12 and other pieces of hardware included in a synchrocyclotron define a tunable resonant circuit under an oscillating voltage input that creates an oscillating electric field across gap 13. The result is a resonant cavity in vacuum chamber 8. This resonant frequency of the resonant cavity can be tuned to keep its Q-factor high by synchronizing the frequency being swept. In one example, the resonant frequency of the resonant cavity moves, or "sweeps", within a range of about 30 Megahertz (MHz) and about 135 MHz (VHF range) over time, e.g., over about 1 millisecond (ms). In another example, the resonant frequency of the resonant cavity moves, or sweeps, between about 95 MHz and about 135 MHz in about 1 ms. Resonance of the cavity may be controlled in the manner described in U.S. patent application Ser. No. 11/948,359, entitled "Matching A Resonant Frequency Of A Resonant Cavity To A Frequency Of An Input Voltage", the contents of which are incorporated herein by reference as if set forth in full.

The Q-factor is a measure of the "quality" of a resonant system in its response to frequencies close to the resonant frequency. In this example, the Q-factor is defined as $$Q=1/R\times\sqrt{(L/C)},$$

where R is the active resistance of the resonant circuit, L is the inductance, and C is the capacitance of the resonant circuit.

The tuning mechanism can be, e.g., a variable inductance coil or a variable capacitance. A variable capacitance device can be a vibrating reed or a rotating capacitor. In the example shown in FIGS. 1A and 1B, the tuning mechanism includes rotating capacitor 28. Rotating capacitor 28 includes rotating blades 30 that are driven by a motor 31. During each cycle of motor 31, as blades 30 mesh with blades 32, the capacitance of the resonant circuit that includes dees 10 and 12 and rotating capacitor 28 increases and the resonant frequency decreases. The process reverses as the blades unmesh. Thus, the resonant frequency is changed by changing the capacitance of the resonant circuit. This serves the purpose of reducing, by a large factor, the power required to generate the high voltage applied at the dee/dummy dee gap at the frequency necessary to accelerate the particle beam. The shape of blades 30 and 32 can be machined so as to create the required dependence of resonant frequency on time.

The blade rotation can be synchronized with RF frequency generation so the frequency of the resonant circuit defined by the synchrocyclotron is kept close to the frequency of the alternating voltage potential applied to the resonant cavity. This promotes efficient transformation of applied RF power to RF voltage on the RF dee.

A vacuum pumping system 40 maintains vacuum chamber 8 at a very low pressure so as not to scatter the accelerating beam (or to provide relatively little scattering) and to substantially prevent electrical discharges from the RF dee.

To achieve substantially uniform acceleration in the synchrocyclotron, the frequency and the amplitude of the electric field across the dee gap is varied to account for the relativistic mass increase and radial variation of magnetic field as well as to maintain focus of the beam of particles. The radial variation of the magnetic field is measured as a distance from the center of an outwardly spiraling trajectory of a charged particle.

Figure 2:
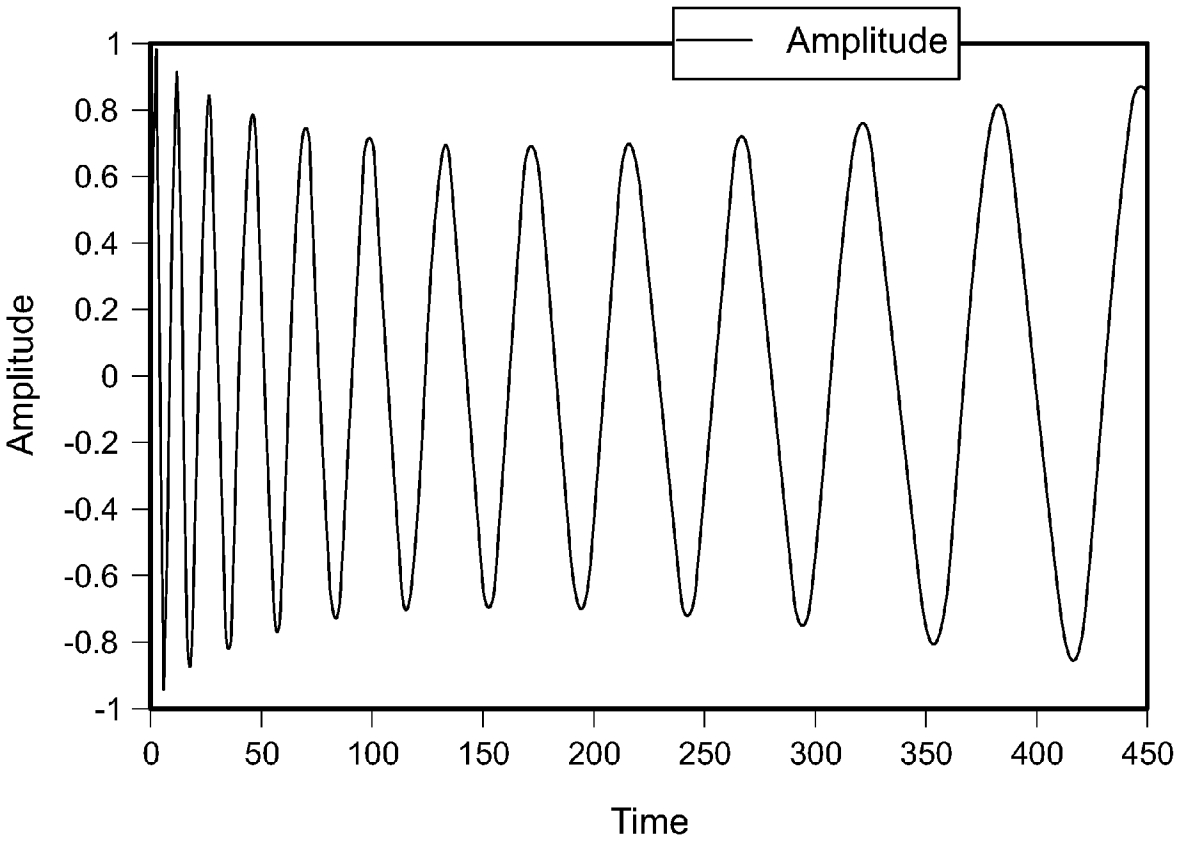
FIG. 2 is an illustration of an idealized waveform that can be used for accelerating charged particles in the synchrocyclotron of FIGS. 1A and 1B.

FIG. 2 is an illustration of an idealized waveform that may be required for accelerating charged particles in a synchrocyclotron. It shows only a few cycles of the waveform and does not necessarily represent the ideal frequency and amplitude modulation profiles. FIG. 2 illustrates the time varying amplitude and frequency properties of the waveform used in the synchrocyclotron. The frequency changes from high to low as the relativistic mass of the particle increases while the particle speed approaches a significant fraction of the speed of light.

Ion source 18 is deployed near to the magnetic center of synchrocyclotron 1 so that particles are present at the synchrocyclotron mid-plane, where they can be acted upon by the RF field (voltage). The ion source may have a Penning ion gauge (PIG) geometry. In the PIG geometry, two high voltage cathodes are placed about opposite each other. For example, one cathode may be on one side of the acceleration region and one cathode may be on the other side of the acceleration region and in line with the magnetic field lines. The dummy dee housings 12 of the source assembly may be at ground potential. The anode includes a tube extending toward the acceleration region. When a relatively small amount of a gas (e.g., hydrogen/$H_2$) occupies a region in the tube between the cathodes, a plasma column may be formed from the gas by applying a voltage to the cathodes. The applied voltage causes electrons to stream along the magnetic field lines, essentially parallel to the tube walls, and to ionize gas molecules that are concentrated inside the tube, thereby creating the plasma column.

Figure 3A:
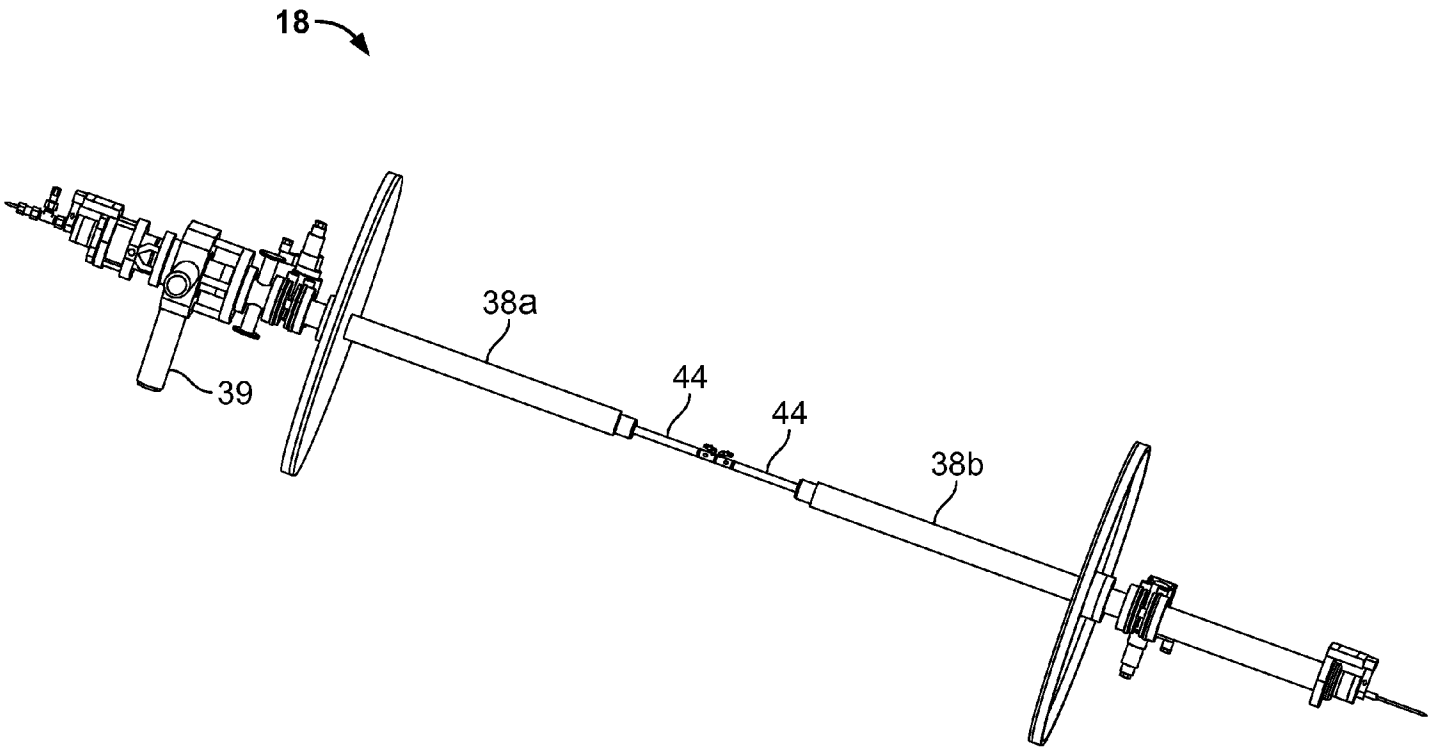
FIG. 3A is a side view of a particle source, such as a Penning ion gauge source.
Figure 3B:
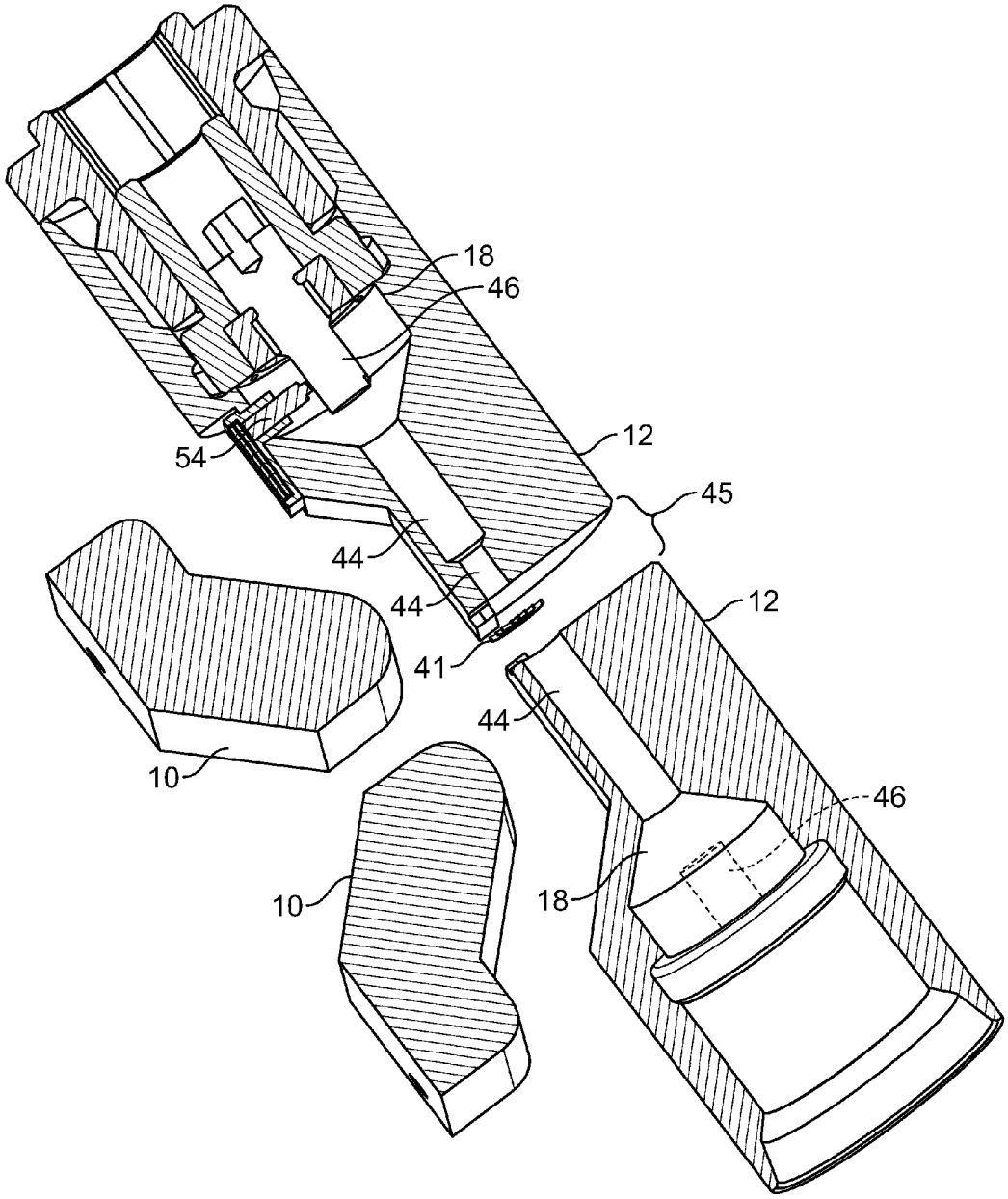
FIG. 3B is a close-up side view of a portion of the particle source of FIG. 3A passing through a dummy dee and adjacent to an RF dee.
Figure 4:
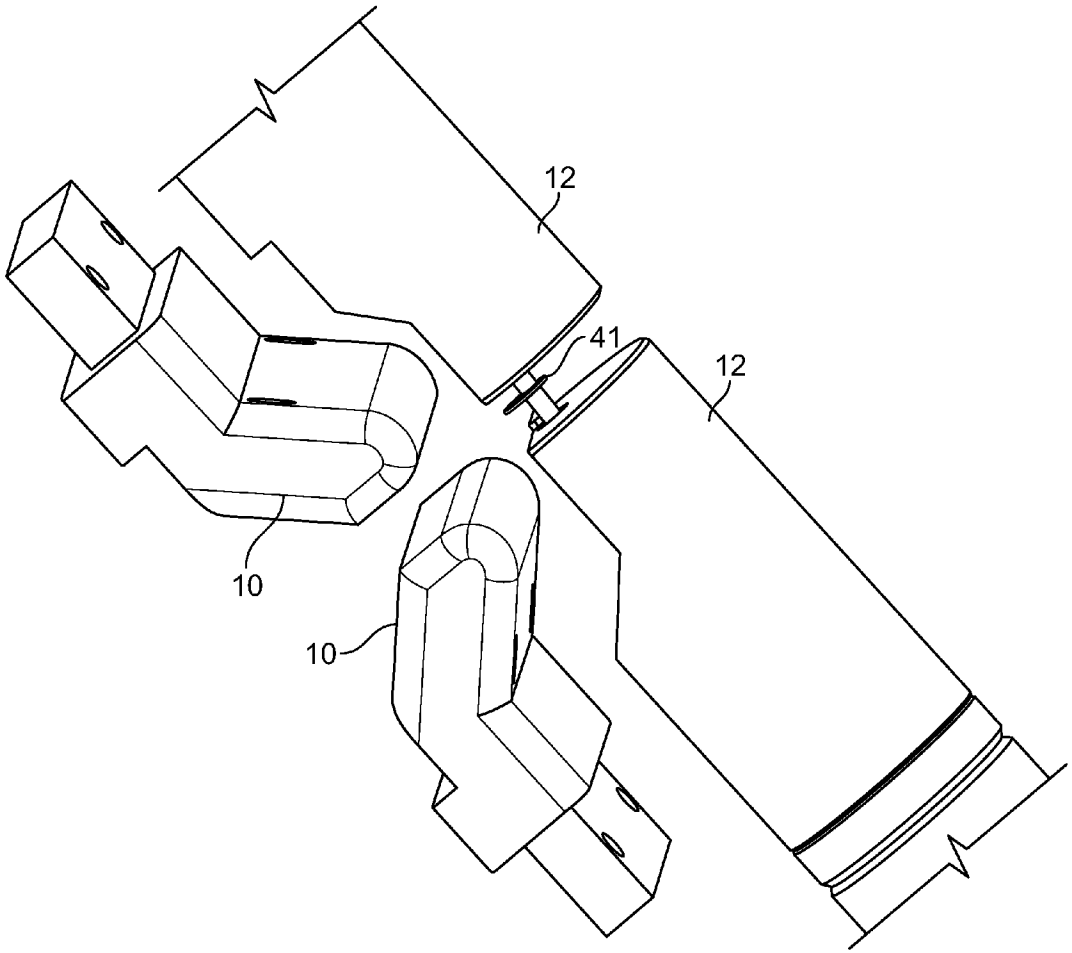
FIG. 4 is a side view of the particle source of FIG. 3 showing spiral acceleration of a particle from a plasma column generated by the particle source.
Figure 5:
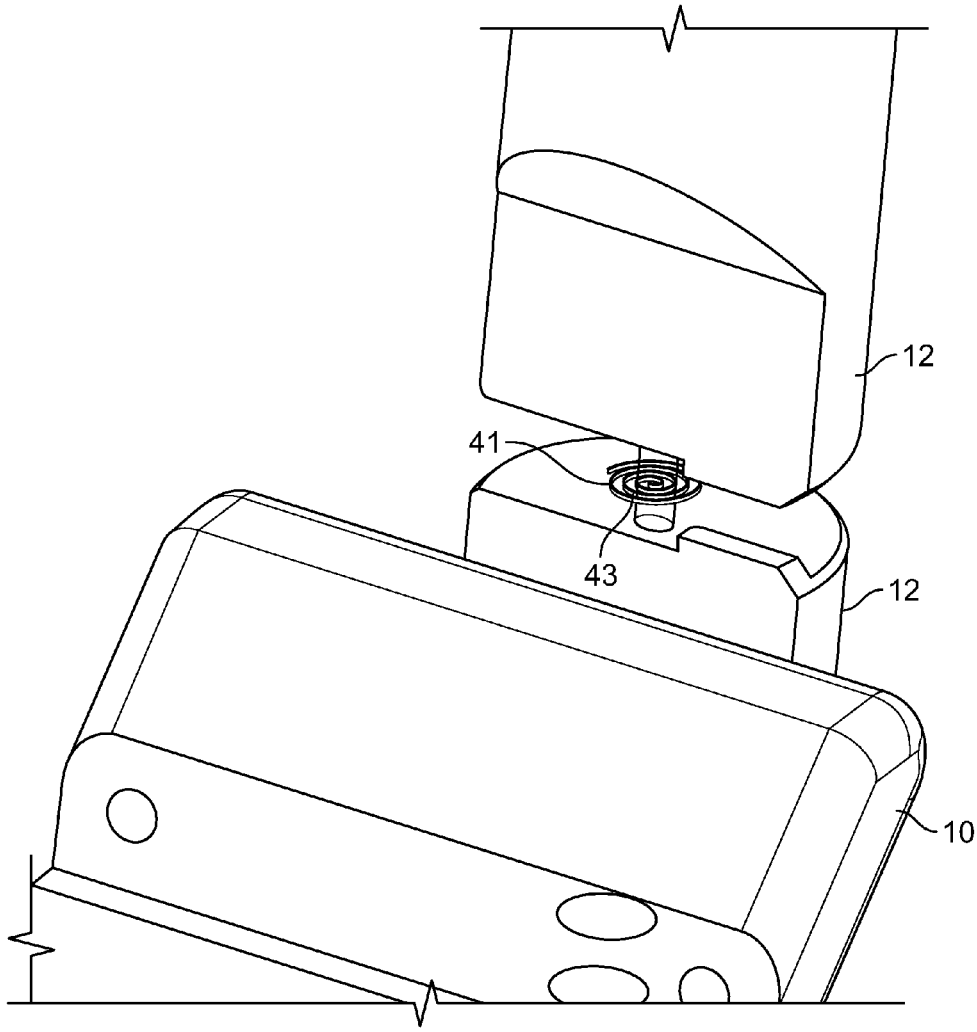
FIG. 5 is a perspective view of the particle source of FIG. 4
Figure 6:
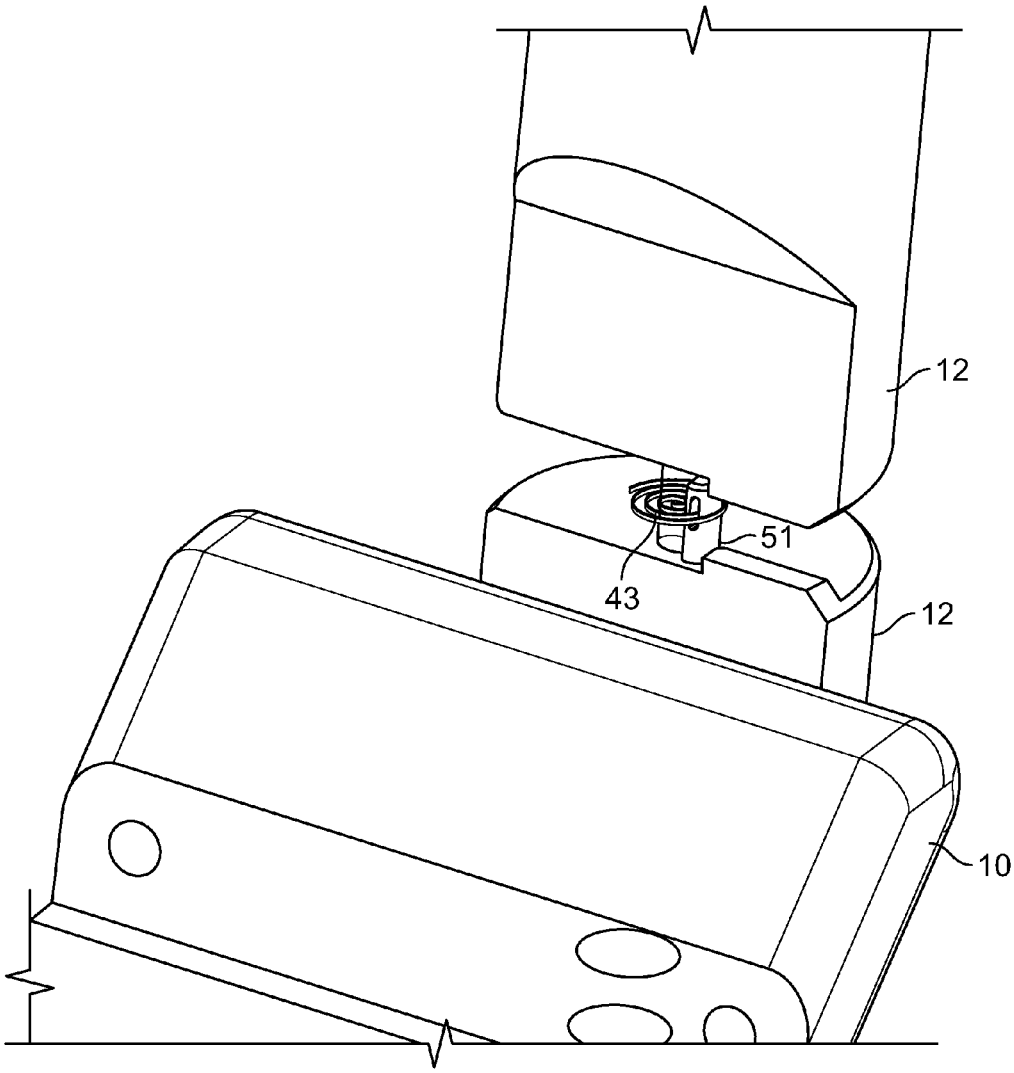
FIG. 6 is a perspective view of the particle source of FIG. 4 containing a stop for blocking one or more phases of particles.

A PIG geometry ion source 18, for use in synchrocyclotron 1, is shown in FIGS. 3A and 3B. Referring to FIG. 3A, ion source 18 includes an emitter side 38*a* containing a gas feed 39 for receiving gas, and a reflector side 38*b*. A housing, or tube, 44 holds the gas, as described below. FIG. 3B shows ion source 18 passing through dummy dee 12 and adjacent to RF dee 10. In operation, the magnetic field between RF dee 10 and dummy dee 12 causes particles (e.g., protons) to accelerate outwardly. The acceleration is spiral about the plasma column, with the particle-to-plasma-column radius progressively increasing. The spiral acceleration, labeled 43, is depicted in FIGS. 5 and 6. The radii of curvature of the spirals depend on a particle's mass, energy imparted to the particle by the RF field, and a strength of the magnetic field.

When the magnetic field is high, it can become difficult to impart enough energy to a particle so that it has a large enough radius of curvature to clear the physical housing of the ion source on its initial turn(s) during acceleration. The magnetic field is relatively high in the region of the ion source, e.g., on the order of 2 Tesla (T) or more (e.g., 8T, 8.8T, 8.9T, 9T, 10.5T, or more). As a result of this relatively high magnetic field, the initial particle-to-ion-source radius is relatively small for low energy particles, where low energy particles include particles that are first drawn from the plasma column. For example, such a radius may be on the order of 1 mm. Because the radii are so small, at least initially, some particles may come into contact with the ion source's housing area, thereby preventing further outward acceleration of such particles. Accordingly, the housing of ion source 18 is interrupted, or separated to form two parts, as shown in FIG. 3B. That is, a portion of the ion source's housing is removed at the acceleration region 41, e.g., at about the point where the particles are to be drawn from the ion source. This interruption is labeled 45 in FIG. 3B. The housing may also be removed for distances above, and below, the acceleration region. All or part of dummy dee 12 at the acceleration region may, or may not, also be removed.

In the example of FIGS. 3A and 3B, the housing 44 includes a tube, which holds a plasma column containing particles to be accelerated. The tube may have different diameters at different points, as shown. The tube may reside within dummy dee 12, although this is not necessary. A portion of the tube in about a median plane of the synchrocyclotron is completely removed, resulting in a housing comprised of two separate portions with an interruption 45 between the portions. In this example, the interruption is about 1 millimeter (mm) to 3 mm (i.e., about 1 mm to 3 mm of the tube is removed). The amount of the tube that is removed may be significant enough to permit particle acceleration from the plasma column, but small enough to hinder significant dissipation of the plasma column in the interrupted portion.

By removing the physical structure, here the tube, at the particle acceleration region, particles can make initial turn(s) at relatively small radii—e.g., in the presence of relatively high magnetic fields—without coming in to contact with physical structures that impede further acceleration. The initial turn(s) may even cross back through the plasma column, depending upon the strength of the magnetic and RF fields.

The tube may have a relatively small interior diameter, e.g., about 2 mm. This leads to a plasma column that is also relatively narrow and, therefore, provides a relatively small set of original radial positions at which the particles can start accelerating. The tube is also sufficiently far from cathodes 46 used to produce the plasma column—in this example, about 10 mm from each cathode. These two features, combined, reduce the amount of hydrogen ($H_2$) gas flow into the synchrocyclotron to less than 1 standard cubic centimeter per minute (SCCM), thereby enabling the synchrocyclotron to operate with relatively small vacuum conductance apertures into the synchrocyclotron RF/beam cavity and relatively small capacity vacuum pump systems, e.g., about 500 liters-per-second.

Interruption of the tube also supports enhanced penetration of the RF field into the plasma column. That is, since there is no physical structure present at the interruption, the RF field can easily reach the plasma column. Furthermore, the interruption in the tube allows particles to be accelerated from the plasma column using different RF fields. For example, lower RF fields may be used to accelerate the particles. This can reduce the power requirements of systems used to generate the RF field. In one example, a 20 kilowatt (kW) RF system generates an RF field of 15 kilovolts (kV) to accelerate particles from the plasma column. The use of lower RF fields reduces RF system cooling requirements and RF voltage standoff requirements.

In the synchrocyclotron described herein, a particle beam is extracted using a resonant extraction system. That is, the amplitude of radial oscillations of the beam are increased by a magnetic perturbation inside the accelerator, which is in resonance with these oscillations. When a resonant extraction system is used, extraction efficiency is improved by limiting the phase space extent of the internal beam. With attention to the design of the magnetic and RF field generating structures, the phase space extent of the beam at extraction is determined by the phase space extent at the beginning of acceleration (e.g., at emergence from the ion source). As a result, relatively little beam may be lost at the entrance to the extraction channel and background radiation from the accelerator can be reduced.

A physical structure, or stop, may be provided to control the phase of the particles that are allowed to escape from the central region of the synchrocyclotron. An example of such a stop 51 is shown in FIG. 6. Stop 51 acts as a obstacle that blocks particles having certain phases. That is, particles that hit the stop are prevented from accelerating further, whereas particles that pass the stop continue their acceleration out of the synchrocyclotron. A stop may be near the plasma column, as shown in FIG. 6, in order to select phases during the initial turn(s) of particles where the particle energy is low, e.g., less than 50 kV. Alternatively, a stop may be located at any other point relative to the plasma column. In the example shown in FIG. 6, a single stop is located on the dummy dee 12. There, however, may be more than one stop (not shown) per dee.

Cathodes 46 may be "cold" cathodes. A cold cathode may be a cathode that is not heated by an external heat source. Also, the cathodes may be pulsed, meaning that they output signal burst(s) periodically rather than continuously. When the cathodes are cold, and are pulsed, the cathodes are less subject to wear and can therefore last relatively long. Furthermore, pulsing the cathodes can eliminate the need to water-cool the cathodes. In one implementation, cathodes 46 pulse at a relatively high voltage, e.g., about 1 kV to about 4 kV, and moderate peak cathode discharge currents of about 50 mA to about 200 mA at a duty cycle between about 0.1% and about 1% or 2% at repetition rates between about 200 Hz to about 1 KHz.

Cold cathodes can sometimes cause timing jitter and ignition delay. That is, lack of sufficient heat in the cathodes can affect the time at which electrons are discharged in response to an applied voltage. For example, when the cathodes are not sufficiently heated, the discharge may occur several microseconds later, or longer, than expected. This can affect formation of the plasma column and, thus, operation of the particle accelerator. To counteract these effects, voltage from the RF field in cavity 8 may be coupled to the cathodes. Cathodes 46 are otherwise encased in a metal, which forms a Faraday shield to substantially shield the cathodes from the RF field. In one implementation, a portion of the RF energy may be coupled to the cathodes from the RF field, e.g., about 100V may be coupled to the cathodes from the RF field. FIG. 3B shows an implementation, in which a capacitive circuit 54, here a capacitor, is charged by the RF field and provides voltage to a cathode 46. An RF choke and DC feed may be used to charge the capacitor. A corresponding arrangement (not shown) may be implemented for the other cathode 46. The coupled RF voltage can reduce the timing jitter and reduce the discharge delay to about 100 nanoseconds (ns) or less in some implementations.

Figure 7:
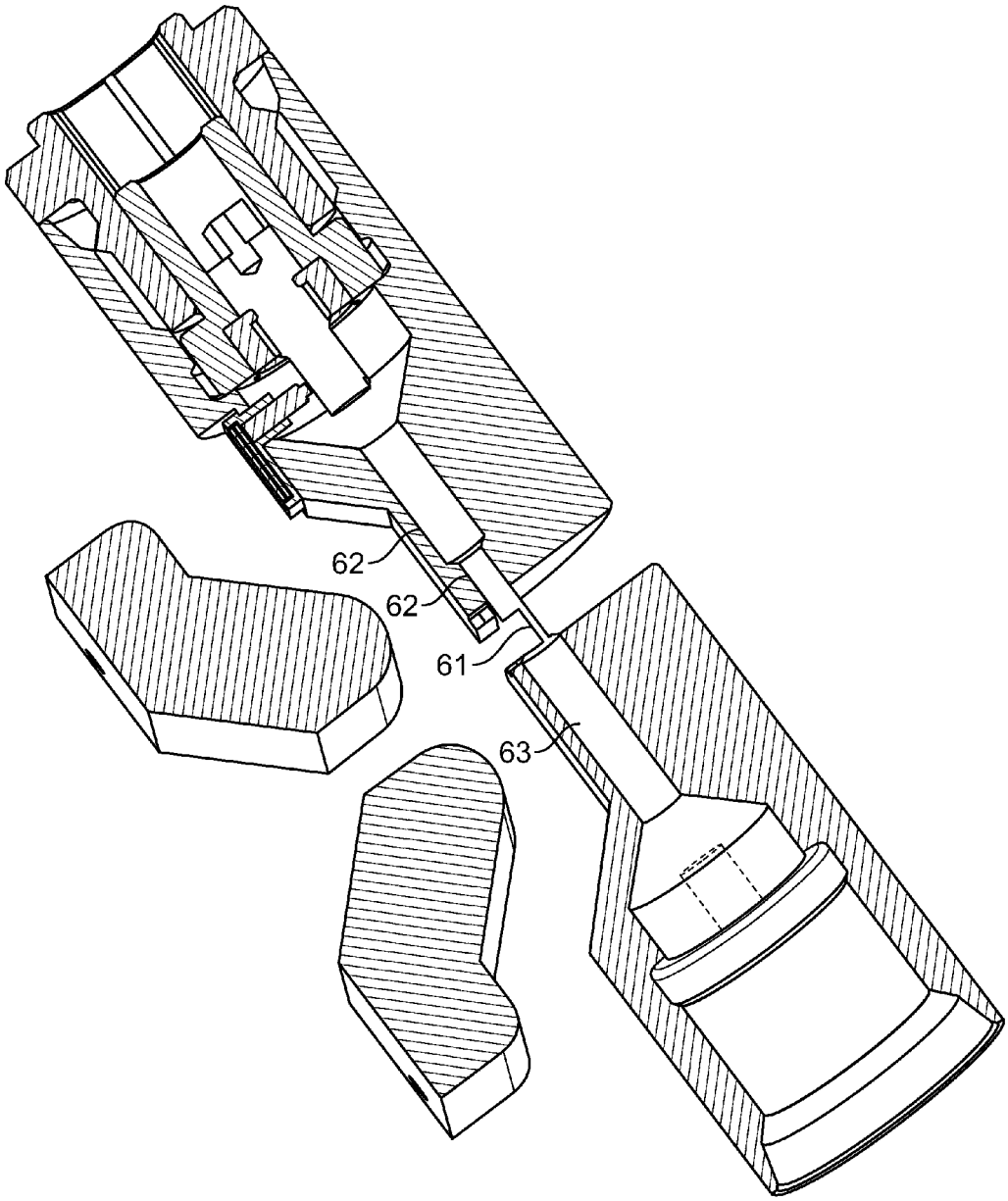
FIG. 7 is a perspective view of an alternative embodiment, in which a substantial portion of the ion source is removed.

An alternative embodiment is shown in FIG. 7. In this embodiment, a substantial portion, but not all, of the PIG source housing is removed, leaving the plasma beam partly exposed. Thus, portions of the PIG housing are separated from their counterpart portions, but there is not complete separation as was the case above. The portion 61 that remains physically connects the first tube portion 62 and the second tube portion 63 of the PIG source. In this embodiment, enough of the housing is removed to enable particles to perform at least one turn (orbit) without impinging on the portion 61 of the housing that remains. In one example, the first turn radius may be 1 mm, although other turn radii may be implemented. The embodiment shown in FIG. 7 may be combined with any of the other features described herein.

The particle source and accompanying features described herein are not limited to use with a synchrocyclotron, but rather may be used with any type of particle accelerator or cyclotron. Furthermore ion sources other than those having a PIG geometry may be used with any type of particle accelerator, and may have interrupted portions, cold cathodes, stops, and/or any of the other features described herein.

Components of different implementations described herein may be combined to form other embodiments not specifically set forth above. Other implementations not specifically described herein are also within the scope of the following claims.

What is claimed is:

1. A synchrocyclotron comprising:

magnetic structures to provide a magnetic field to a cavity;

a particle source to provide a plasma column to the cavity, the particle source having a housing to hold the plasma column, the housing being interrupted at an acceleration region to expose the plasma column, wherein the housing is interrupted such that less than a majority of the housing is present at the acceleration region; and a voltage source to provide a radio frequency (RF) voltage to the cavity to accelerate particles from the plasma column at the acceleration region.

2. The synchrocyclotron of claim 1, wherein the magnetic field is above 2 Tesla (T), and the particles accelerate from the plasma column outwardly in spirals with radii that progressively increase.

3. The synchrocyclotron of claim 1, wherein the housing comprises two portions that are completely separated at the acceleration region to expose the plasma column.

4. The synchrocyclotron of claim 1, wherein the voltage source comprises a first dee that is electrically connected to an alternating voltage and a second dee that is electrically connected to ground; and wherein at least part of the particle source passes through the second dee.

5. The synchrocyclotron of claim 1, further comprising a stop in the acceleration region, the stop for blocking acceleration of at least some of the particles from the plasma column.

6. The synchrocyclotron of claim 5, wherein the stop is substantially orthogonal to the acceleration region and is configured to block certain phases of particles from the plasma column.

7. The synchrocyclotron of claim 1, further comprising:
cathodes for use in generating the plasma column, the cathodes being operable to pulse a voltage to ionize gas to generate the plasma column;
wherein the cathodes are not heated by an external heat source.

8. The synchrocyclotron of claim 7, wherein the cathodes are configured to pulse at voltages between about 1kV to about 4kV.

9. The synchrocyclotron of claim 7, further comprising:
a circuit to couple voltage from the RF voltage to the at least one of the cathodes.

10. The synchrocyclotron of claim 9, wherein the circuit comprises a capacitive circuit.

11. The synchrocyclotron of claim 1, wherein the magnetic structures comprise magnetic yokes, wherein the voltage source comprises a first dee that is electrically connected to an alternating voltage and a second dee that is electrically connected to ground, wherein the first dee and the second dee form a tunable resonant circuit, and wherein the cavity comprises a resonant cavity containing the tunable resonant circuit.

12. A synchrocyclotron comprising:
a tube containing a gas;
a first cathode adjacent to a first end of the tube; and
a second cathode adjacent to a second end of the tube, the first and second cathodes applying voltage to the tube to form a plasma column from the gas;
wherein particles are available to be drawn from the plasma column for acceleration; and
a circuit to couple energy from an external radio frequency (RF) field to at least one of the cathodes;
wherein the tube is interrupted at a region where the particles are accelerated to expose the plasma column, wherein the tube is interrupted such that less than a majority of the tube is present at the region where the particles are accelerated.

13. The synchrocyclotron of claim 12; wherein the first cathode and the second cathode are not heated by an external source.

14. The synchrocyclotron of claim 13, further comprising:
a voltage source to provide the RF field, the RF field for accelerating the particles from the plasma column at the region where the particles are accelerated.

15. The synchrocyclotron of claim 14, wherein the energy comprises a portion of the RF field provided by the voltage source.

16. The synchrocyclotron of claim 13, wherein the circuit comprises a capacitor to couple the energy from the external field to at least one of the first cathode and the second cathode.

17. The synchrocyclotron of claim 13, wherein the tube comprises a first portion and a second portion that are completely separated at the region where the particles are accelerated.

18. The synchrocyclotron of claim 13, further comprising:
a stop at the acceleration region, the stop to block at least one phase of the particles from further acceleration.

19. The synchrocyclotron of claim 13, further comprising:
a voltage source to provide the RF field to the plasma column, the RF field for accelerating the particles from the plasma column at the region where the particles are accelerated, wherein the RF field comprises voltage that is less than 15kV; and
magnetic yokes to provide a magnetic field that crosses the region where the particles are accelerated, the magnetic field being greater than about 2 Tesla (T).

20. The synchrocyclotron of claim 12, wherein the first cathode is on a different side of the acceleration region than the second cathode.

21. A synchrocyclotron comprising:
a Penning ion gauge (PIG) source comprising a first tube portion and a second tube portion, the first tube portion and the second tube portion for holding a plasma column that extends across an acceleration region from which particles are accelerated from the plasma column; and
a voltage source to provide a voltage at the acceleration region, the voltage for accelerating particles out of the plasma column at the acceleration region;
wherein less than a majority of a connection is present between the first tube portion and the second tube portion at the acceleration region.

22. The synchrocyclotron of claim 21, wherein the first tube portion and the second tube portion are completely separated from each other at the acceleration region.

23. The synchrocyclotron of claim 21, wherein portions of the first tube portion are separated from corresponding portions of the second tube portion; and
wherein the PIG source comprises a physical connection between a part of the first tube portion and the second tube portion, the physical connection enabling particles accelerating out of the plasma column to complete a first turn upon escaping from the plasma column without running into the physical connection.

24. The synchrocyclotron of claim 21, wherein the PIG source passes through a first dee that is electrically connected to ground, and wherein a second dee that is electrically connected to an alternating voltage source provides the voltage at the acceleration region.

25. The synchrocyclotron of claim 21, further comprising:
magnetic yokes that define a cavity containing the acceleration region, the magnetic yokes for generating a magnetic field across the acceleration region.

26. The synchrocyclotron of claim 25, wherein the magnetic field is at least 2 Tesla (T).

27. The synchrocyclotron of claim 26, wherein the magnetic field is at least 10.5T.

28. The synchrocyclotron of claim 27, wherein the voltage comprises a radio frequency (RF) voltage that is less than 15kV.

29. The synchrocyclotron of claim 21, further comprising one or more electrodes for use in accelerating the particles out of the particle accelerator.

30. The synchrocyclotron of claim 21, further comprising:
at least one cathode for use in generating the plasma column, the at least one cathode comprising a cold cathode; and
a capacitive circuit to couple at least some of the voltage to the at least one cathode.

31. The synchrocyclotron of claim 30, wherein the at least one cathode is configured to pulse voltage to generate the plasma column from gas in the first tube portion and the second tube portion.

32. The synchrocyclotron of claim 31, further comprising a structure that substantially encloses the PIG source.

33. A particle accelerator comprising:
a tube containing a gas;
a first cathode adjacent to a first end of the tube;
a second cathode adjacent to a second end of the tube, the first and second cathodes applying voltage to the tube to form a plasma column from the gas;
wherein particles are available to be drawn from the plasma column for acceleration;

a circuit to couple energy from an external radio frequency (RF) field to at least one of the cathodes; and magnetic structures to provide a magnetic field that crosses the region where the particles are accelerated, the magnetic field being greater than about 2 Tesla (T);

wherein the tube is interrupted at a region where the particles are accelerated to expose the plasma column, and wherein the tube is interrupted such that less than a majority of the tube is present at the region where the particles are accelerated,

34. The particle accelerator of claim 33, wherein the first cathode and the second cathode are not heated by an external source.

35. The particle accelerator of claim 34, further comprising:

a voltage source to provide the RF field, the RF field for accelerating the particles from the plasma column at the region where the particles are accelerated.

36. The particle accelerator of claim 35, wherein the energy comprises a portion of the RF field provided by the voltage source.

37. The particle accelerator of claim 34, wherein the circuit comprises a capacitor to couple the energy from the external field to at least one of the first cathode and the second cathode.

38. The particle accelerator of claim 34, wherein the tube comprises a first portion and a second portion that are completely separated at the region where the particles are accelerated.

39. The particle accelerator of claim 34, further comprising:

a stop at the region where the particles are accelerated, the stop to block at least one phase of the particles from further acceleration.

40. The particle accelerator of claim 34, further comprising:

a voltage source to provide the RF field to the plasma column, the RF field for accelerating the particles from the plasma column at the region where the particles are accelerated, wherein the RF field comprises voltage that is less than 15kV; and where the magnetic structures comprise magnetic yokes.

41. The particle accelerator of claim 33, wherein the first cathode is on a different side of the region where the particles are accelerated than the second cathode.

42. The particle accelerator of claim 33, wherein the magnetic field is greater than 8T.

43. The particle accelerator of claim 33, wherein the magnetic field is greater than 10.5T.

* * * * *

UNITED STATES PATENT AND TRADEMARK OFFICE

CERTIFICATE OF CORRECTION

PATENT NO. : 8,581,523 B2
APPLICATION NO. : 11/948662
DATED : November 12, 2013
INVENTOR(S) : Kenneth P. Gall et al.

It is certified that error appears in the above-identified patent and that said Letters Patent is hereby corrected as shown below:

In the Claims

Column 11, Line 10, In claim 33, delete "accelerated," and insert -- accelerated. --

Signed and Sealed this
Twenty-third Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,581,523 B2
APPLICATION NO. : 11/948662
DATED : November 12, 2013
INVENTOR(S) : Gall et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 967 days.

Signed and Sealed this
Eleventh Day of August, 2015

Michelle K. Lee

Michelle K. Lee
*Director of the United States Patent and Trademark Office*